US008043004B2

(12) United States Patent
Mogil

(10) Patent No.: US 8,043,004 B2
(45) Date of Patent: Oct. 25, 2011

(54) CONTAINER WITH EXPANDABLE PORTION

(75) Inventor: Melvin S. Mogil, Toronto (CA)

(73) Assignee: California Innovations, Inc. (CA)

( * ) Notice: Subject to any disclaimer, the term of this patent is extended or adjusted under 35 U.S.C. 154(b) by 1052 days.

(21) Appl. No.: 11/443,631

(22) Filed: May 31, 2006

(65) Prior Publication Data

US 2007/0278234 A1 Dec. 6, 2007

(51) Int. Cl.

| | |
|---|---|
| ***B65D 30/22*** | (2006.01) |
| ***B65D 33/06*** | (2006.01) |
| ***B65D 81/38*** | (2006.01) |
| ***B65D 30/08*** | (2006.01) |
| ***A45C 11/20*** | (2006.01) |
| ***F25D 23/00*** | (2006.01) |
| ***F25D 3/08*** | (2006.01) |

(52) U.S. Cl. ..... 383/38; 383/16; 383/40; 383/110; 383/111; 206/541; 220/592.2; 62/457.7; D7/607

(58) Field of Classification Search ..... 383/110, 383/2, 38, 16, 111; D7/607, 605; 62/457.7; 220/592.2; 150/112, 107, 113, 114, 117; 190/109, 111, 103, 110; 206/541; *F25D 3/08; B65D 81/38*

See application file for complete search history.

(56) References Cited

U.S. PATENT DOCUMENTS

| | | | | | |
|---|---|---|---|---|---|
| 2,730,152 | A | * | 1/1956 | Stakofsky | 150/116 |
| 2,827,096 | A | | 3/1958 | Hinson | |
| 2,851,076 | A | * | 9/1958 | Stakofsky | 150/116 |
| 3,001,566 | A | | 9/1961 | Lipsitz | |
| RE25,826 | E | | 8/1965 | Ward | |
| 4,177,909 | A | | 12/1979 | Haskell | |
| 4,334,601 | A | | 6/1982 | Davis | |
| 4,378,866 | A | | 4/1983 | Pelavin | |
| 4,609,084 | A | * | 9/1986 | Thomas | 190/110 |
| 4,673,117 | A | | 6/1987 | Calton | |
| 4,706,856 | A | | 11/1987 | Jacober | |
| 4,752,008 | A | * | 6/1988 | Pratt | 206/579 |
| 4,817,802 | A | * | 4/1989 | Pratt | 206/579 |
| 4,941,603 | A | | 7/1990 | Creamer et al. | |
| D312,530 | S | | 12/1990 | Gallen et al. | |
| 4,984,662 | A | | 1/1991 | Jacober | |
| D316,012 | S | | 4/1991 | Christopher | |
| 5,010,988 | A | * | 4/1991 | Brown | 190/104 |
| 5,054,589 | A | | 10/1991 | Bomes et al. | |
| D328,550 | S | | 8/1992 | Mogil et al. | |
| 5,160,001 | A | | 11/1992 | Marceau | |
| 5,209,328 | A | | 5/1993 | Kotkins, Jr. | |
| 5,217,119 | A | | 6/1993 | Hollingsworth | |
| 5,337,911 | A | | 8/1994 | Holub | |
| D352,827 | S | | 11/1994 | Schildkraut | |

(Continued)

*Primary Examiner* — Jes F Pascua

(74) *Attorney, Agent, or Firm* — Ostrolenk Faber LLP

(57) ABSTRACT

A soft sided insulated container assembly has a first insulated container portion and a second insulated container portion. The second insulated container portion can be collapsed to a flat position, and secured in place. Either of the container portions may have a liner. The liner in the first container portion may be a substantially rigid liner. The assembly may have a lifting member. In one example the second portion may be hingedly mounted to the first portion, and the lifting member may be mounted such that when the assembly is lifted, the hinge is in an up-and-down orientation. In another embodiment, the lifting member may be eccentrically mounted, such that the assembly may possibly sit more comfortably against a carrier's hip. The first container portion may have an auxiliary opening or door, and that door may be more easily opened than the main access of the first insulated container portion.

20 Claims, 29 Drawing Sheets

U.S. PATENT DOCUMENTS

| | | | | | |
|---|---|---|---|---|---|
| D355,568 | S | | 2/1995 | Paulin et al. | |
| 5,403,095 | A | | 4/1995 | Melk | |
| 5,472,279 | A | | 12/1995 | Lin | |
| 5,490,623 | A | | 2/1996 | McConnell | |
| 5,497,919 | A | * | 3/1996 | Klinger | 224/416 |
| 5,501,338 | A | | 3/1996 | Preston | |
| 5,505,307 | A | | 4/1996 | Shink | |
| D370,123 | S | | 5/1996 | Klinger | |
| D371,052 | S | | 6/1996 | Melk | |
| 5,526,907 | A | | 6/1996 | Trawick et al. | |
| D382,771 | S | | 8/1997 | Mogil | |
| D382,772 | S | | 8/1997 | Mogil | |
| D387,249 | S | | 12/1997 | Mogil | |
| D394,552 | S | | 5/1998 | Melk | |
| 5,842,571 | A | | 12/1998 | Rausch | |
| 5,865,314 | A | | 2/1999 | Jacober | |
| 5,873,504 | A | * | 2/1999 | Farmer | 224/576 |
| 5,964,384 | A | | 10/1999 | Young | |
| 5,974,826 | A | | 11/1999 | Baldwin et al. | |
| 6,015,072 | A | | 1/2000 | Young | |
| D419,770 | S | | 2/2000 | Mogil | |
| 6,102,172 | A | * | 8/2000 | Dercole | 190/18 A |
| 6,105,844 | A | | 8/2000 | Walters et al. | |
| 6,116,045 | A | | 9/2000 | Hodosh et al. | |
| 6,234,677 | B1 | | 5/2001 | Mogil | |
| 6,237,776 | B1 | | 5/2001 | Mogil | |
| 6,238,091 | B1 | | 5/2001 | Mogil | |
| 6,247,328 | B1 | | 6/2001 | Mogil | |
| D446,937 | S | | 8/2001 | Mogil | |
| 6,296,165 | B1 | | 10/2001 | Mears | |
| 6,363,739 | B1 | | 4/2002 | Hodosh et al. | |
| 6,439,389 | B1 | | 8/2002 | Mogil | |
| 6,481,239 | B2 | | 11/2002 | Hodosh et al. | |
| 7,162,890 | B2 | | 1/2007 | Mogil et al. | |
| 7,232,018 | B1 | * | 6/2007 | Salander | 190/108 |
| 2003/0024960 | A1 | | 2/2003 | Greenstein et al. | |
| 2005/0103044 | A1 | | 5/2005 | Mogil et al. | |

* cited by examiner

CONTAINER WITH EXPANDABLE PORTION

FIELD OF THE INVENTION

This invention relates to the field of portable insulated containers.

BACKGROUND OF THE INVENTION

Soft sided insulated containers have become popular for carrying either articles that may best be served cool, such as beverages or salads, or warm, such as appetizers, hot dogs, and so on. Such containers are frequently used to carry liquids, whether hot liquids, such as soup containers, coffee or tea, or cold liquids such as beer, soft drinks, or other carbonated beverages, juices and milk. Sometimes these containers may by used to carry lunches, which may include a sandwich, fruit, carrot and celery sticks, a drink, cookies, and so on.

It may be that a container of this nature may be desired for the purpose of carrying two different types of objects. For example, some objects may quite appropriately be warm, while others may be more desirably kept cool or cold. Alternatively, some objects may be damp, while others may best be kept dry. It may also be that whereas one container may be in frequent use, the need for a second container, or container portion, may be intermittent or infrequent. It may be that one portion of the insulated container may sometimes be employed for carrying objects that may not be food items. It may be that the container may advantageously stand up for storage or for packing in the refrigerator, and yet be more conveniently reposed on a back side at other times.

SUMMARY OF THE INVENTION

In an aspect of the invention there is a soft-sided insulated container assembly. It has a first insulated container portion and a second insulated container portion. The first insulated container portion has a length and a breadth and a depth, the length being greater than the breadth, and the breadth being greater than the depth. The first insulated container portion has a first panel. The first panel has a predominantly rectangular plan form. The rectangular plan form has a pair of first and second generally opposed long sides, and a pair of first and second generally opposed short sides.

In another feature of that aspect of the invention, the first panel has a periphery. The first insulated container portion has an insulated peripheral wall mounted about the first panel. The peripheral wall extends away from the first panel in a direction of the depth, and the insulated peripheral wall has a margin distant from the first panel. The first insulated container portion has a second panel. The second panel has a predominantly rectangular plan form that has a pair of first and second long sides, and a pair of first and second short sides. The second panel is hingedly mounted to the margin of the peripheral wall along one of the long sides thereof. The second panel is movable between a closed position and an open position relative to the peripheral wall.

In another feature of that aspect of the invention, the first insulated container has a first closure operable releasably to secure the second panel in the closed position. The second insulated container portion is mounted to the second panel of the first container portion. The second insulated container portion is movable from a collapsed position to an expanded position. The container assembly include members operable releasably to secure the second portion in the collapsed position. The second insulated container portion has a predominantly rectangular footprint corresponding substantially to the predominantly rectangular footprint of the second panel of the first container portion, that has respective first and second long sides, and respective first and second short sides. The second insulated container portion has a second closure mounted along one of the first and second short sides thereof.

In another feature of that aspect of the invention, the peripheral wall has a pair of first and second short sides, and a pair of first and second long sides. The short and long sides stands along the respective first and second short and long sides of the first panel. The first short side of the peripheral wall is closest adjacent to the second closure member. A lifting member is mounted to the peripheral wall whereby the first short side of the peripheral wall is positioned uppermost relative to the second short side of the peripheral wall when the container assembly is supported by the lifting member.

In an additional feature, the second insulated container portion includes a main panel and a peripheral wall. The main panel has a peripheral margin that has a pair of long portions and a short portion adjoining each other in a U-shape. The short portion is distant from the second closure member. The peripheral wall is collapsible to permit the main panel of the second insulated container portion to move to a position closer to the second panel. The second insulated container portion is in the collapsed position. The second insulated container portion is also in the expanded position. In a further feature, the second closure member has a first securement member operable to retain the second closure member in a closed position relative to the second insulated container portion. The second securement member is operable to retain the closure member against the main panel when the second insulated container portion is in the collapsed position.

In still another feature, the lifting member is a handle mounted to the first short side of the peripheral wall of the first insulated container portion. In yet another feature, the insulated container assembly includes a second lifting member that includes a shoulder strap. In another feature, an auxiliary lodgement is mounted to one of the long sides of the peripheral wall of the first insulated container portion opposite to that long portion of the peripheral sidewall to which the second panel is hingedly mounted. In another feature, the lodgement is uninsulated. It also has a base which may be collapsed against the peripheral wall when not in use, and which has an open end closest to the first short side of the peripheral wall. In another feature, at least one of the first and second insulated container portions has a liner. In another feature, the liner is more rigid than the insulated wall structure.

In another aspect of the invention, there is an insulated container assembly which comprises a first insulated container portion and a second insulated container portion. The first and second insulated container portions are soft sided insulated container portions. The first insulated container portion has a length and a breadth and a depth. The length is greater than the depth, and the depth is greater than the breadth. In another feature, the first insulated container portion has a first panel. The first panel has a predominantly rectangular plan form. The rectangular plan form has a pair of first and second generally opposed long sides running predominantly lengthwise, and a pair of first and second generally opposed short sides running breadthwise. The first panel has a periphery.

In another feature, the first insulated container portion has an insulated peripheral wall mounted about the first panel. The peripheral wall has first and second long sides, and first and second short sides. The peripheral wall extends away from the first panel depthwise. Each of the long sides and short sides has an upper margin portion distant from the first panel. The margin portions co-operatively defines an upper margin of the peripheral wall structure. In another feature, the first insulated container portion has a second panel. The second panel has a predominantly rectangular plan form that has a pair of first and second long sides, and a pair of first and second short sides. The second panel is hingedly mounted to the margin of the peripheral wall along the upper margin portion of the second of the long sides thereof.

In another feature, the second panel is movable between a closed position and an open position relative to the peripheral wall. A first closure is operable releasably to secure the second panel in the closed position. The second insulated container portion is mounted to the first of the long sides of the first container portion. The first of the long sides of the peripheral wall defines a back wall of the second insulated container portion. In another feature, the second insulated container portion is movable from a collapsed position to an expanded position. The container assembly include members operable releasably to secure the second insulated container portion in the collapsed position. The second insulated container portion has a predominantly rectangular front wall that stands predominantly opposite the back wall, and side portions adjoining the front and back walls.

In another feature, the second insulated container portion has a bottom wall portion adjacent to the first panel of the first insulated container portion. The second insulated container has a top wall portion distant therefrom. The second insulated container portion has a closure member operable to permit the top wall portion to move to an open position relative to the front wall. The top wall portion has a first securement to permit the top wall portion to close the second insulated container portion when the second insulated container portion is in a collapsed position. The top wall portion also has a second securement operable to fasten the top wall in an overlapping position relative to the front wall when the second insulated container portion is in the collapsed position.

In another feature, the first insulated container portion has a first lifting member mounted thereto. The first lifting member has a center of lift closer to the margin portion of the second long side portion than to the margin portion of the first long side portion. In another feature, the second panel of the first insulated container portion has a movable inset member mounted thereto. The movable inset member is movable to an open position that provides a second means of internal access to the first container portion. In another feature, the inset member has an inset member closure. The first closure is operable to secure the second panel of the first insulated container portion when in the closed position. The first closure is of a different type than the inset member closure. In another feature, the first closure is a tracked fastener, and the second closure is a quick release closure. In another feature, at least one of the first and second insulated container portions has a liner mounted therewithin. In another feature, the liner has a rigidity greater than the peripheral wall of the first insulated container portion.

In another feature, the members operable releasably to secure the second insulated container portion in the collapsed position include straps that has a first end fixedly mounted to the second insulated container portion. There is a free end releasably attachable to the first insulated container portion in at least a first position and a second position. In another feature, the straps are located closer to the bottom wall portion than to the top wall portion of the second insulated container portion. In another feature, the lifting member is a strap. The strap has first and second ends fastened to the first and second short sides of the peripheral wall. In another feature, each of the first and second ends is mounted to an attachment gusset. The gusset has a base fastened to a respective one of the first and second short sides, and an apex closer to the back wall of the second insulated container portion than to the front wall.

These and other aspects of the invention may be more readily understood with the aid of the illustrative Figures and detailed description included hereinbelow.

BRIEF DESCRIPTION OF THE DRAWINGS

These and other aspects of the invention may be more readily understood with the aid of the illustrative Figures included herein below, and showing of an example, or examples, embodying the various aspects of the invention, provided by way of illustration, but not of limitation of the present invention, and in which.

DETAILED DESCRIPTION

Figure 1A:
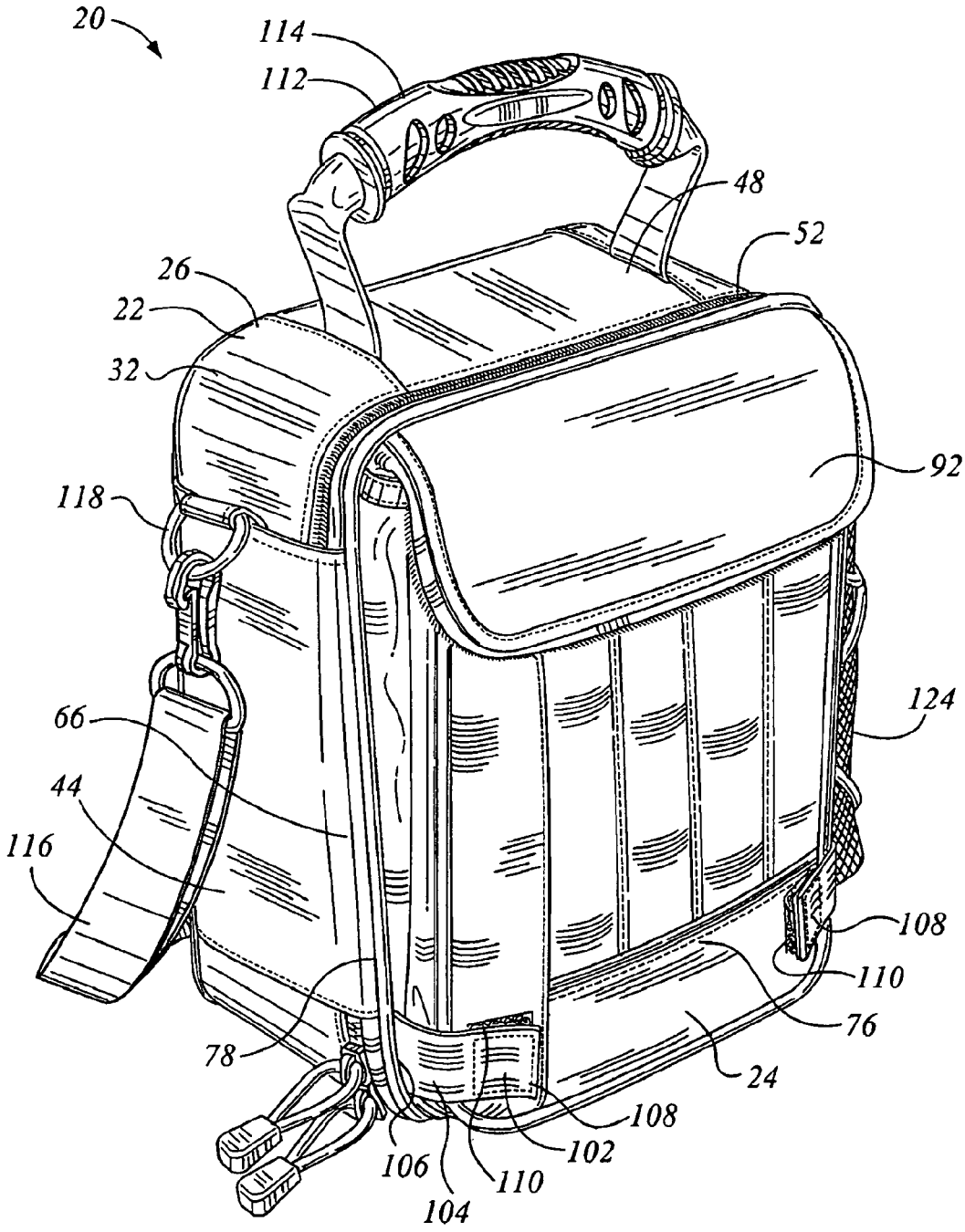
FIG. 1*a* shows a isometric view from in front, to one side and above an example of an embodiment of an insulated container according to an aspect of the present invention.
Figure 1B:
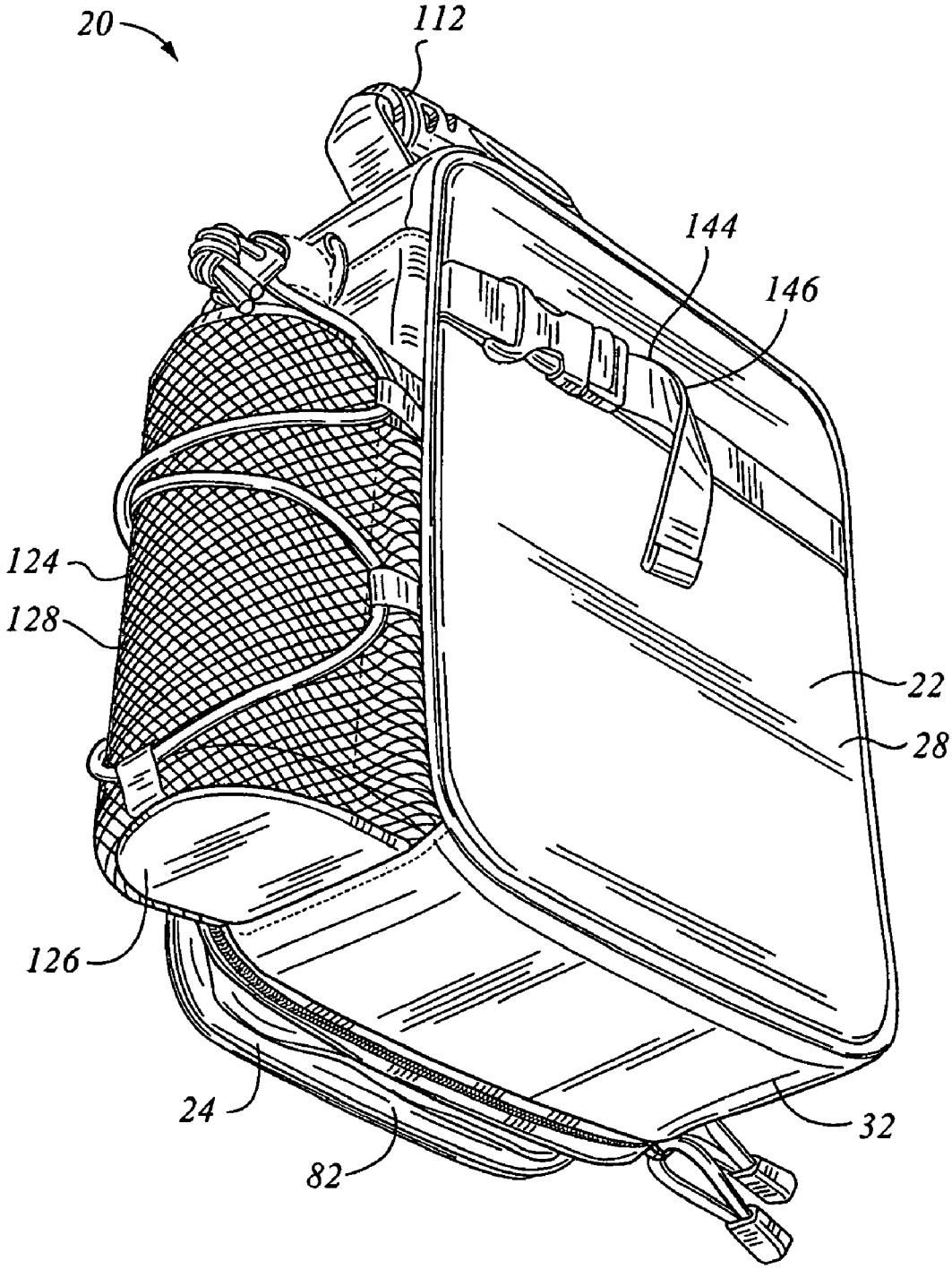
FIG. 1*b* is an opposite isometric view of the container of FIG. 1*a;*
Figure 1C:
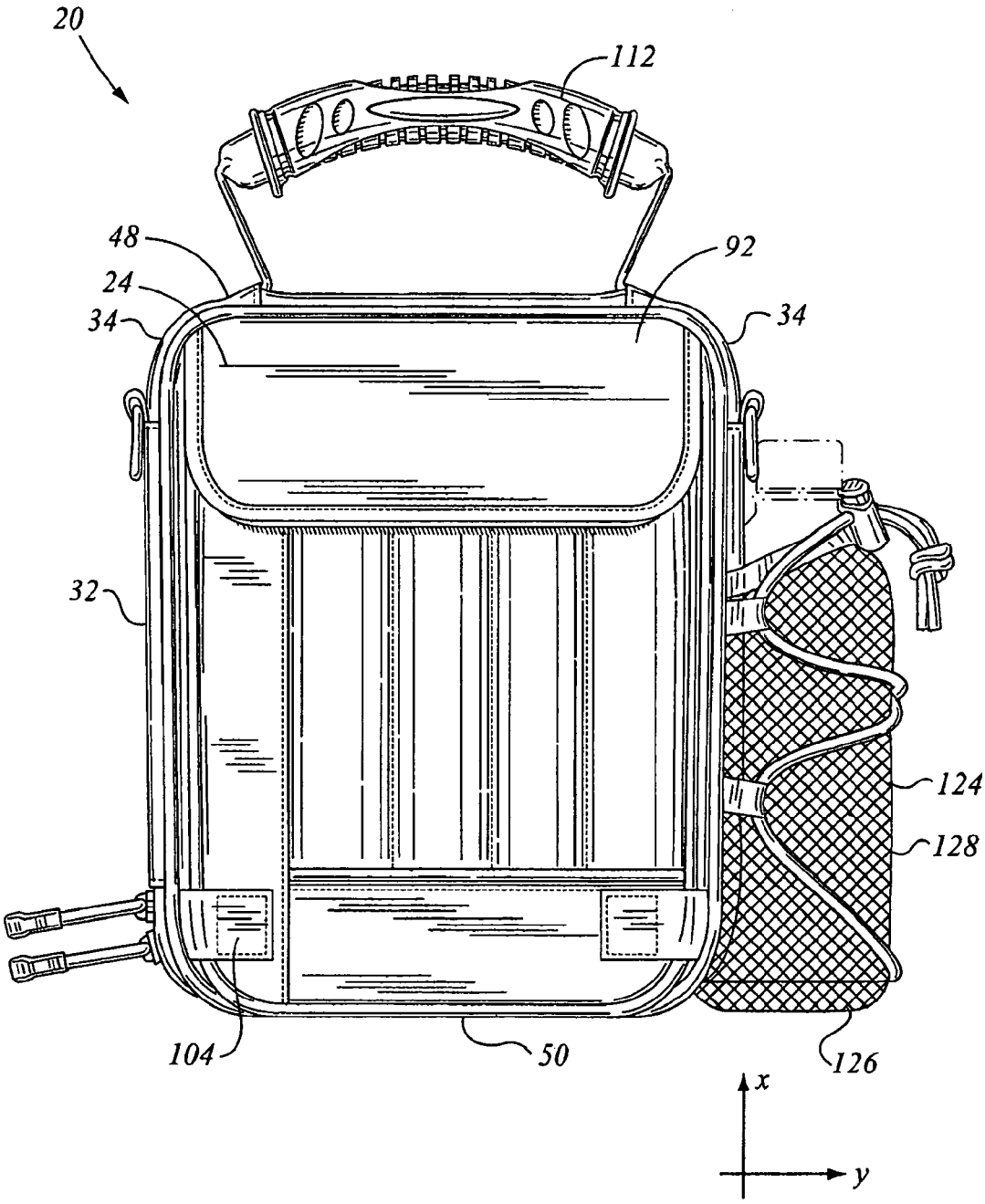
FIG. 1*c* is a front view of the container of FIG. 1*a;*
Figure 1D:
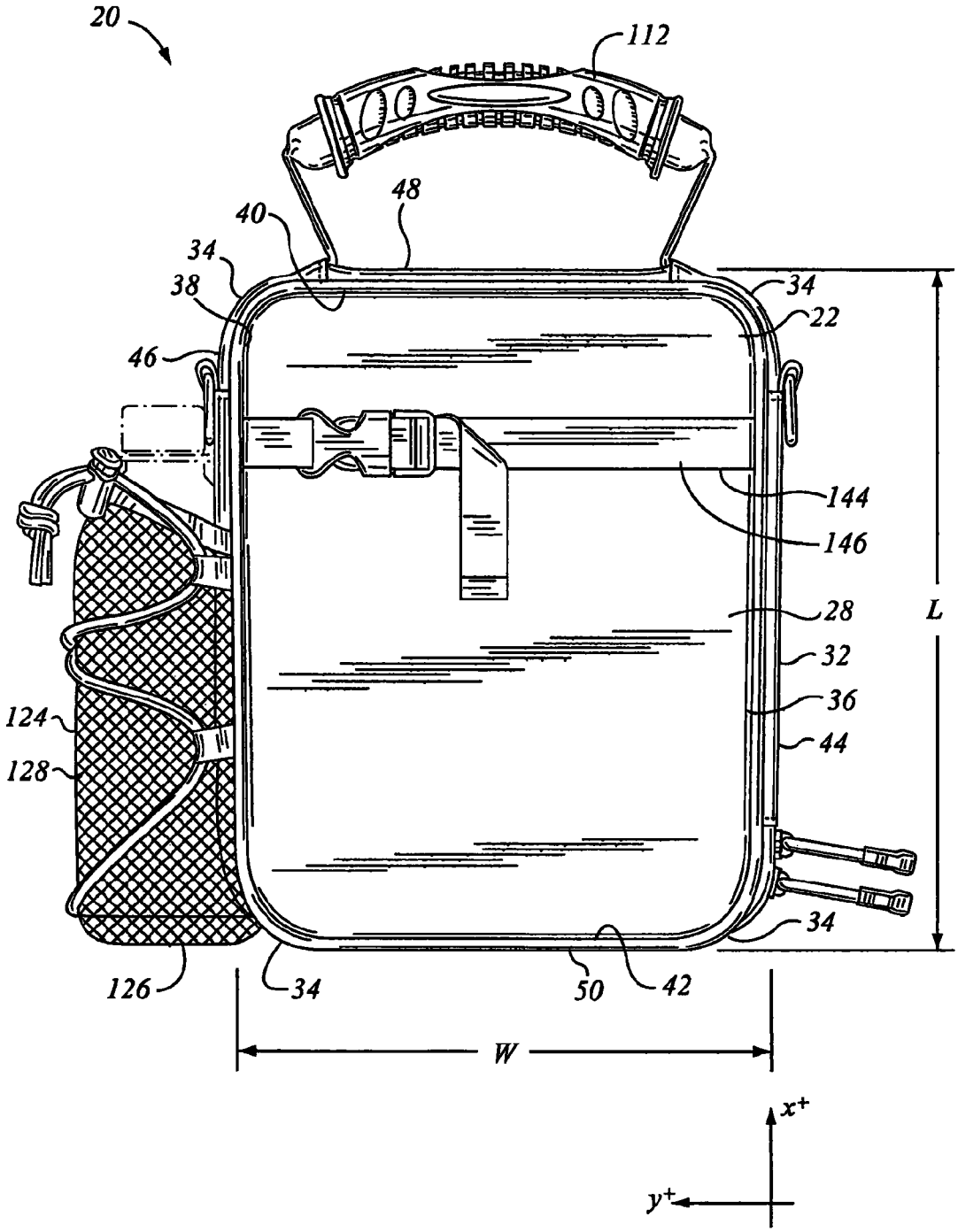
FIG. 1*d* is a rear view of the container of FIG. 1*a;*
Figure 1E:
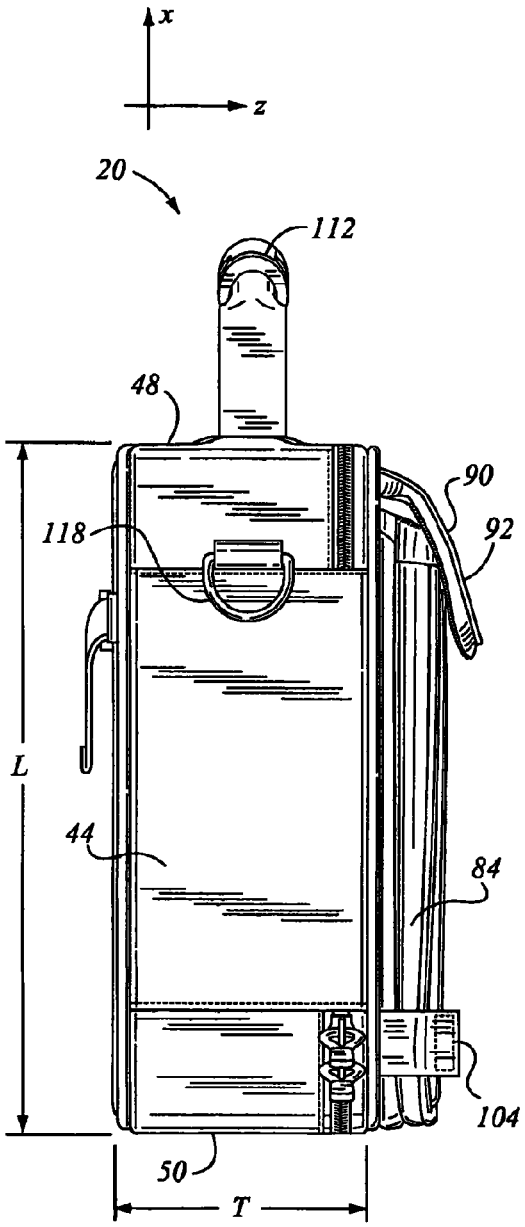
FIG. 1*e* is a left hand end view of the container of FIG. 1*a;*
Figure 1F:
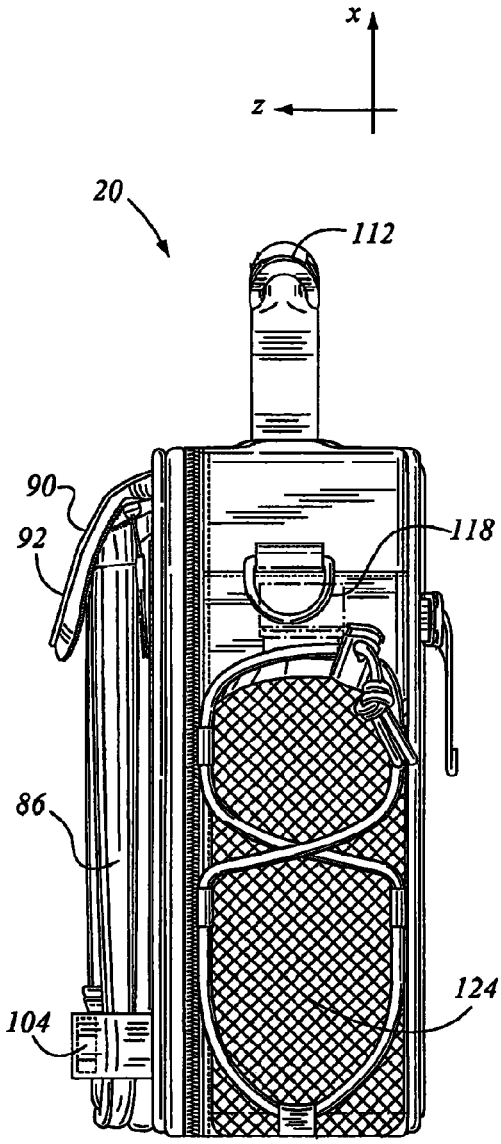
FIG. 1*f* is a right hand end view of the container of FIG. 1*a;*
Figure 1G:
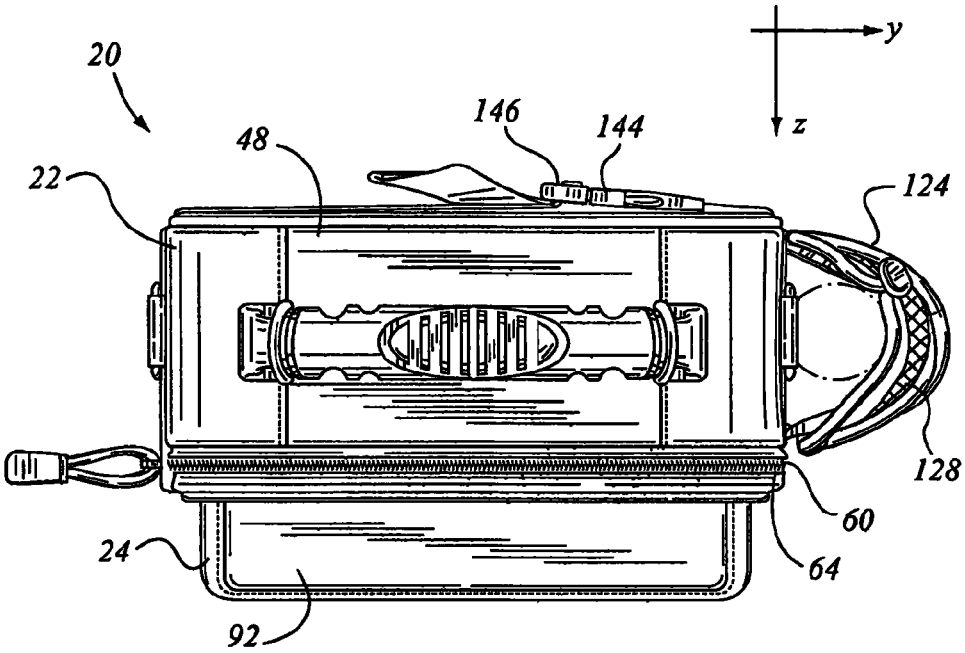
FIG. 1*g* is a top view of the container of FIG. 1*a;*
Figure 1H:
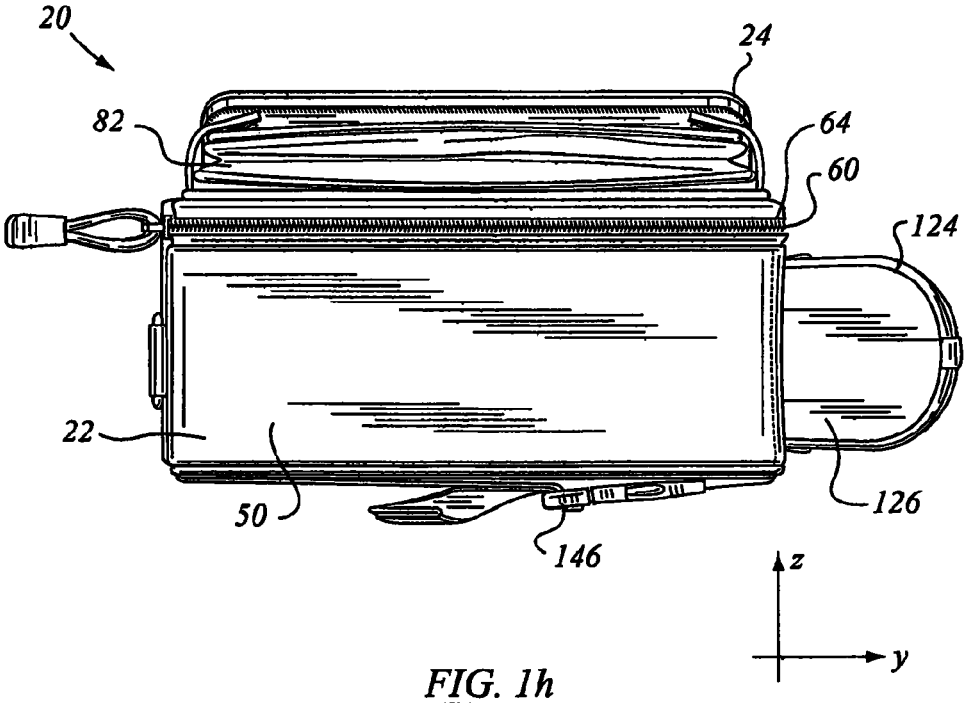
FIG. 1*h* is a bottom view of the container of FIG. 1*a;*
Figure 1I:
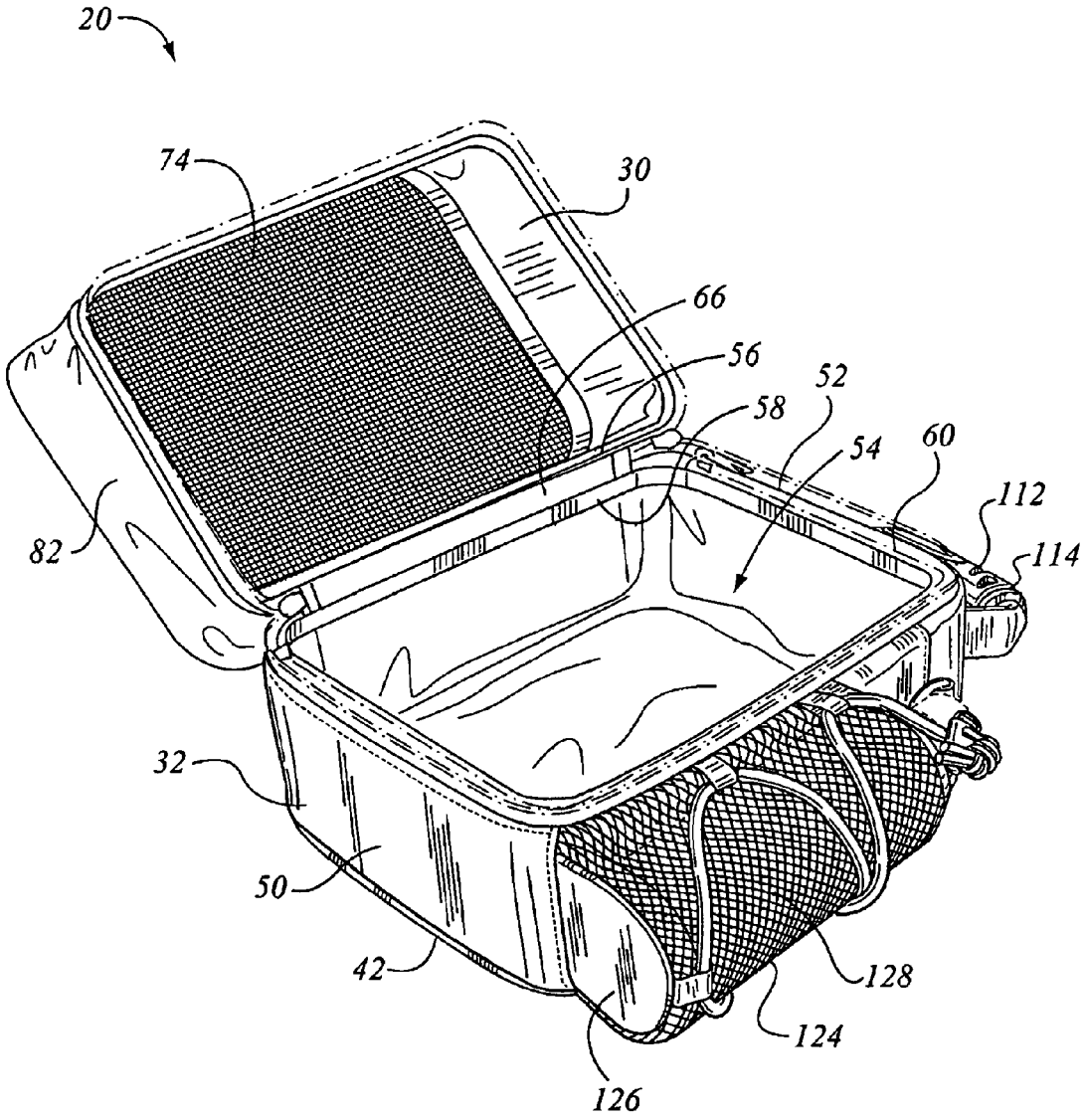
FIG. 1*i* is a view of the container of FIG. 1*a* in an open condition.
Figure 1J:
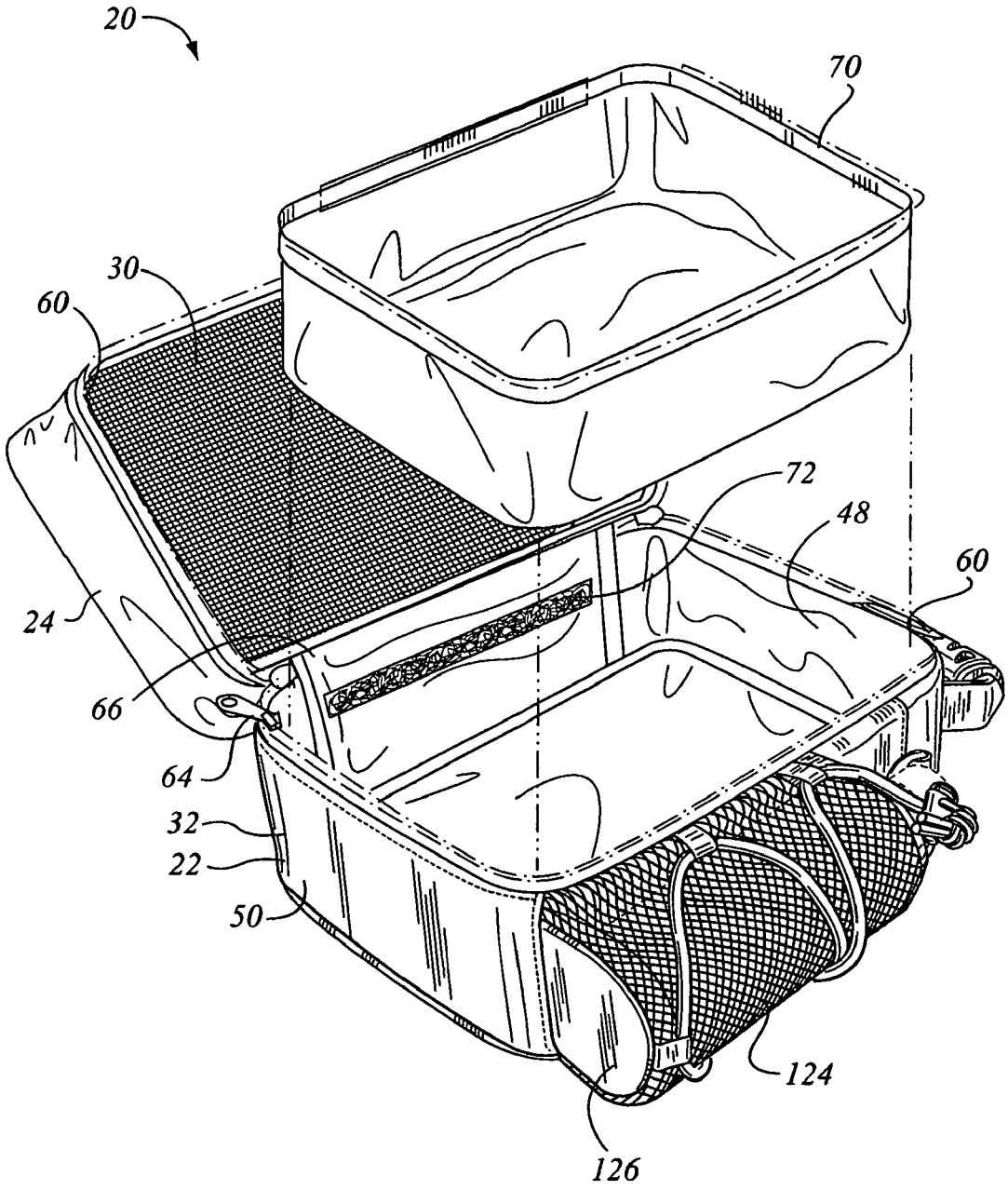
FIG. 1*j* shows the container of FIG. 1*i* with an internal liner removed.
Figure 1K:
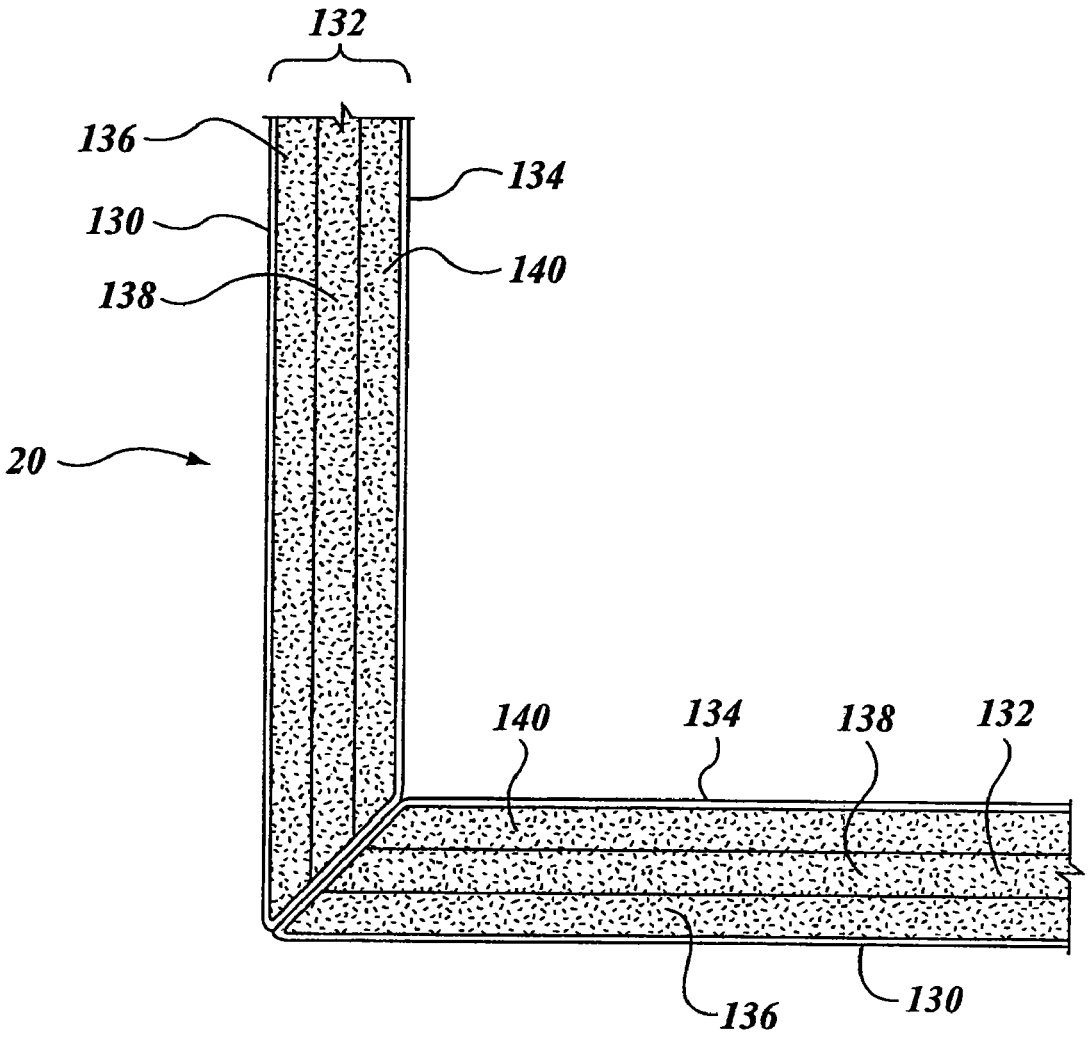
FIG. 1*k* shows a detail of wall cross section of the container of FIG. 1*a;*
Figure 2A:
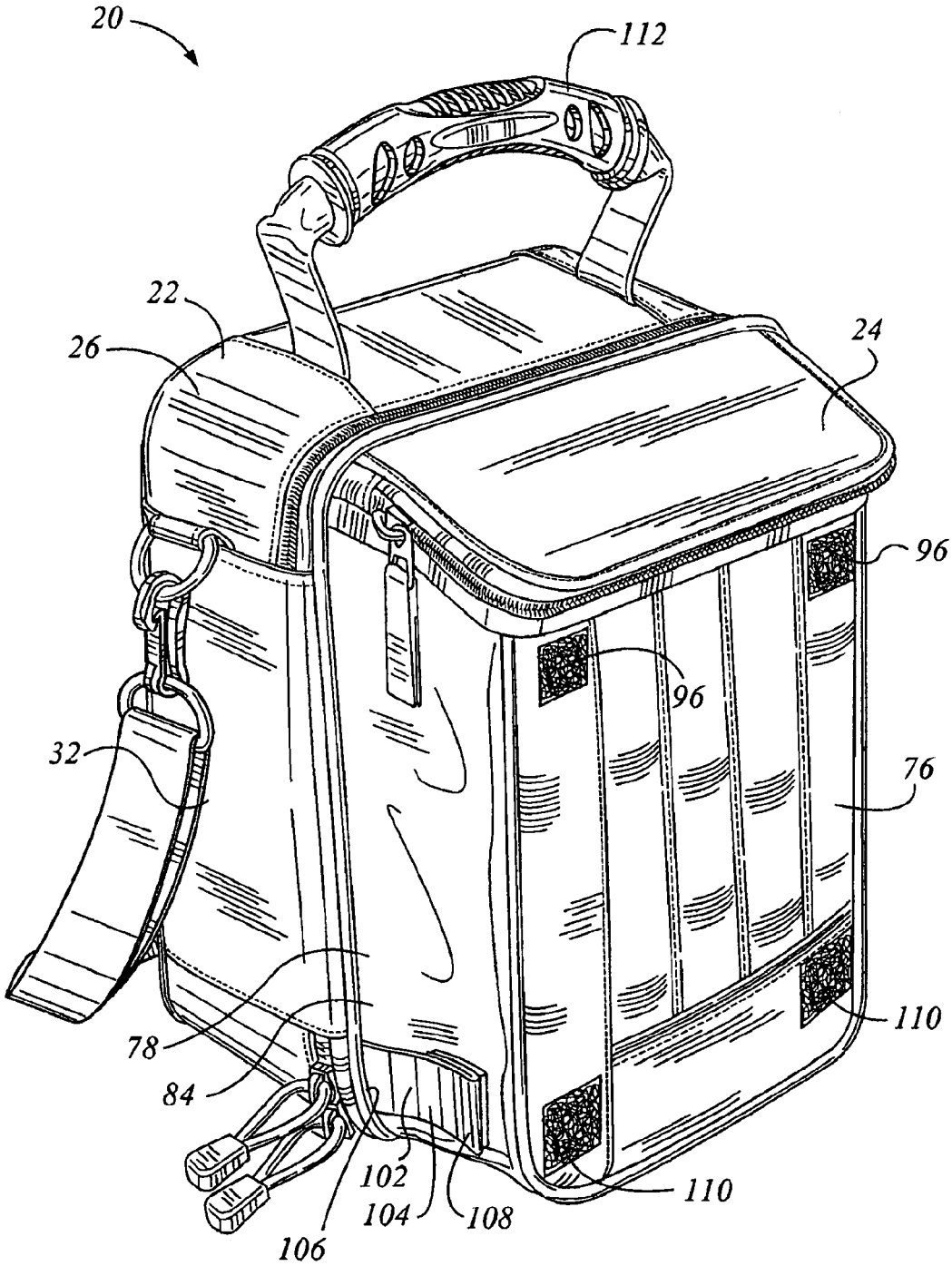
FIG. 2*a* shows a isometric view of the container of FIG. 1*a* is an expanded condition.
Figure 2B:
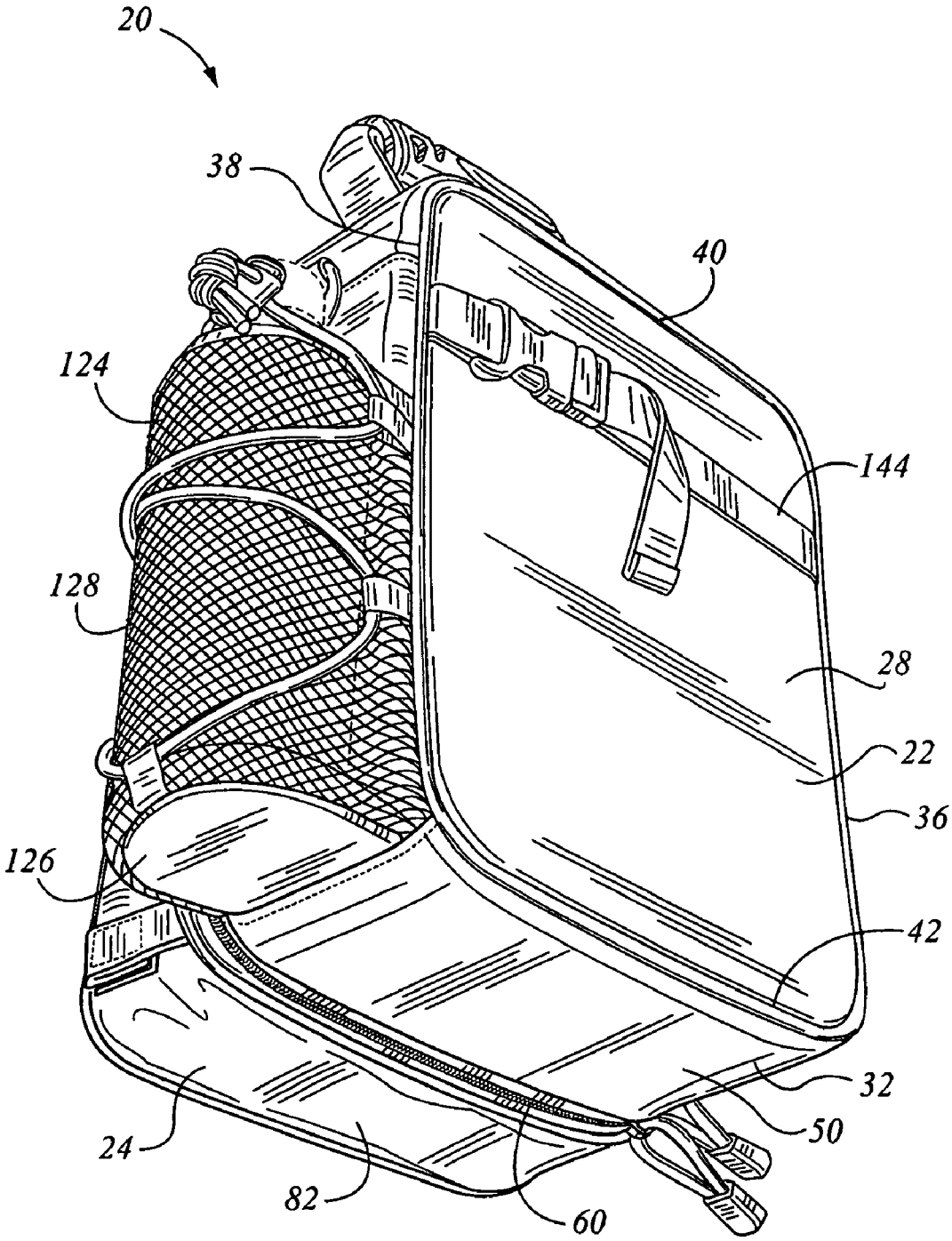
FIG. 2*b* is an opposite isometric view of the container of FIG. 2*a;*
Figure 2C:
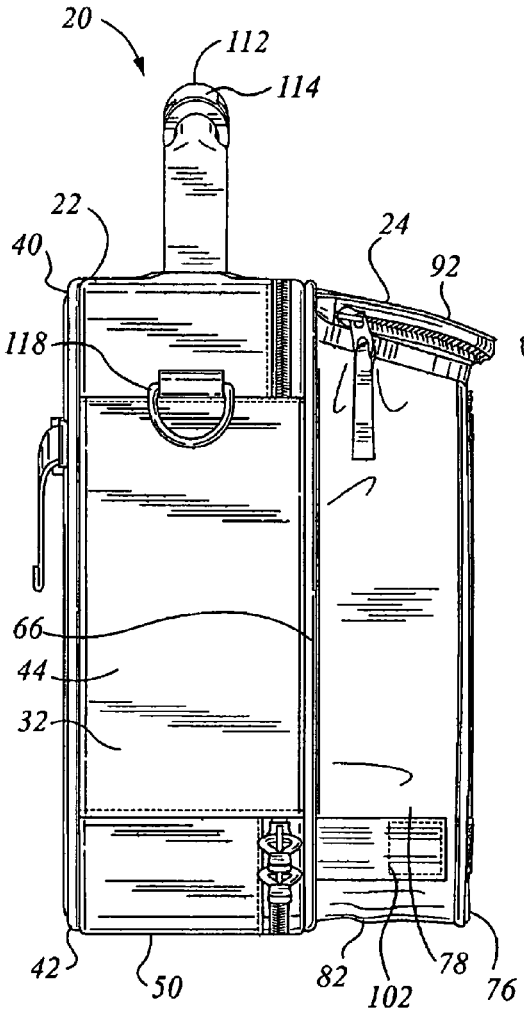
FIG. 2*c* is a left hand end view of the container of FIG. 2*a;*
Figure 2D:
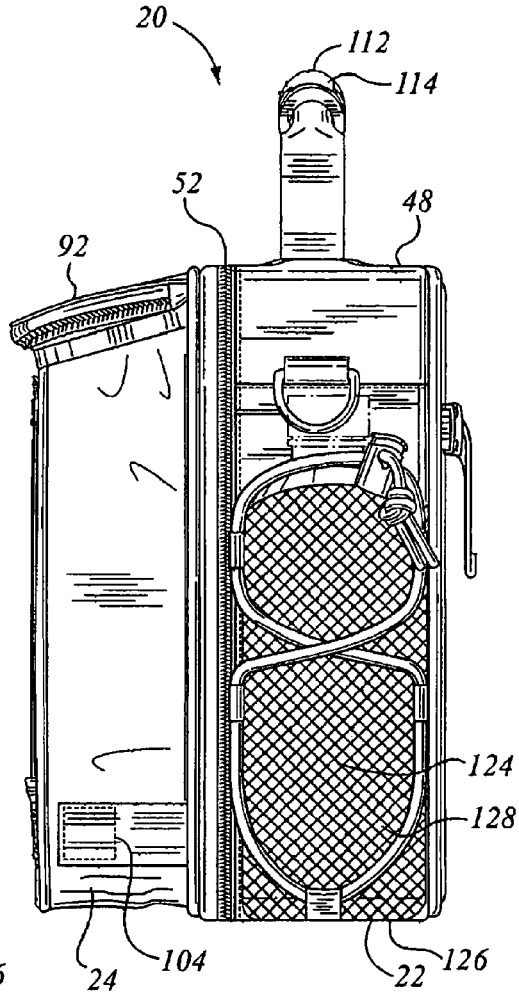
FIG. 2*d* is a right hand end view of the container of FIG. 2*a;*
Figure 2E:
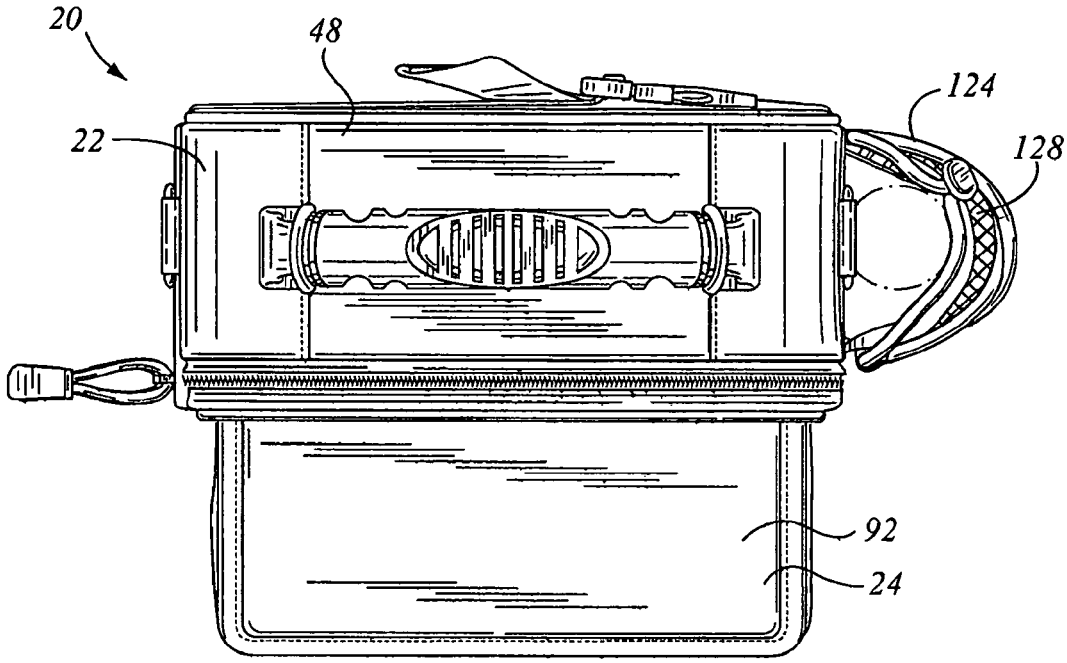
FIG. 2*e* is a top view of the container of FIG. 2*a;*
Figure 2F:
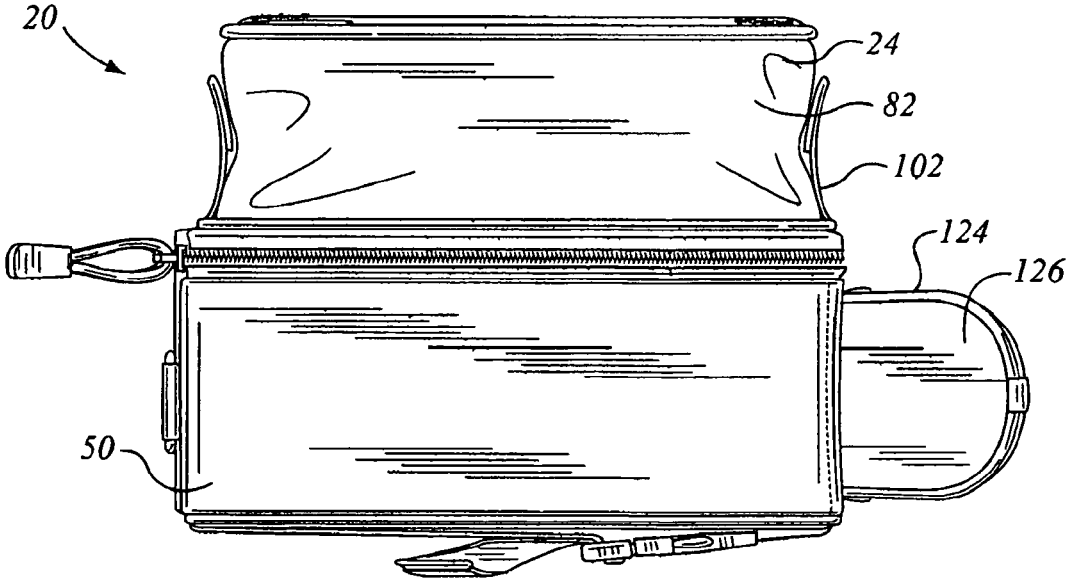
FIG. 2*f* is a bottom view of the container of FIG. 2*a;*
Figure 2G:
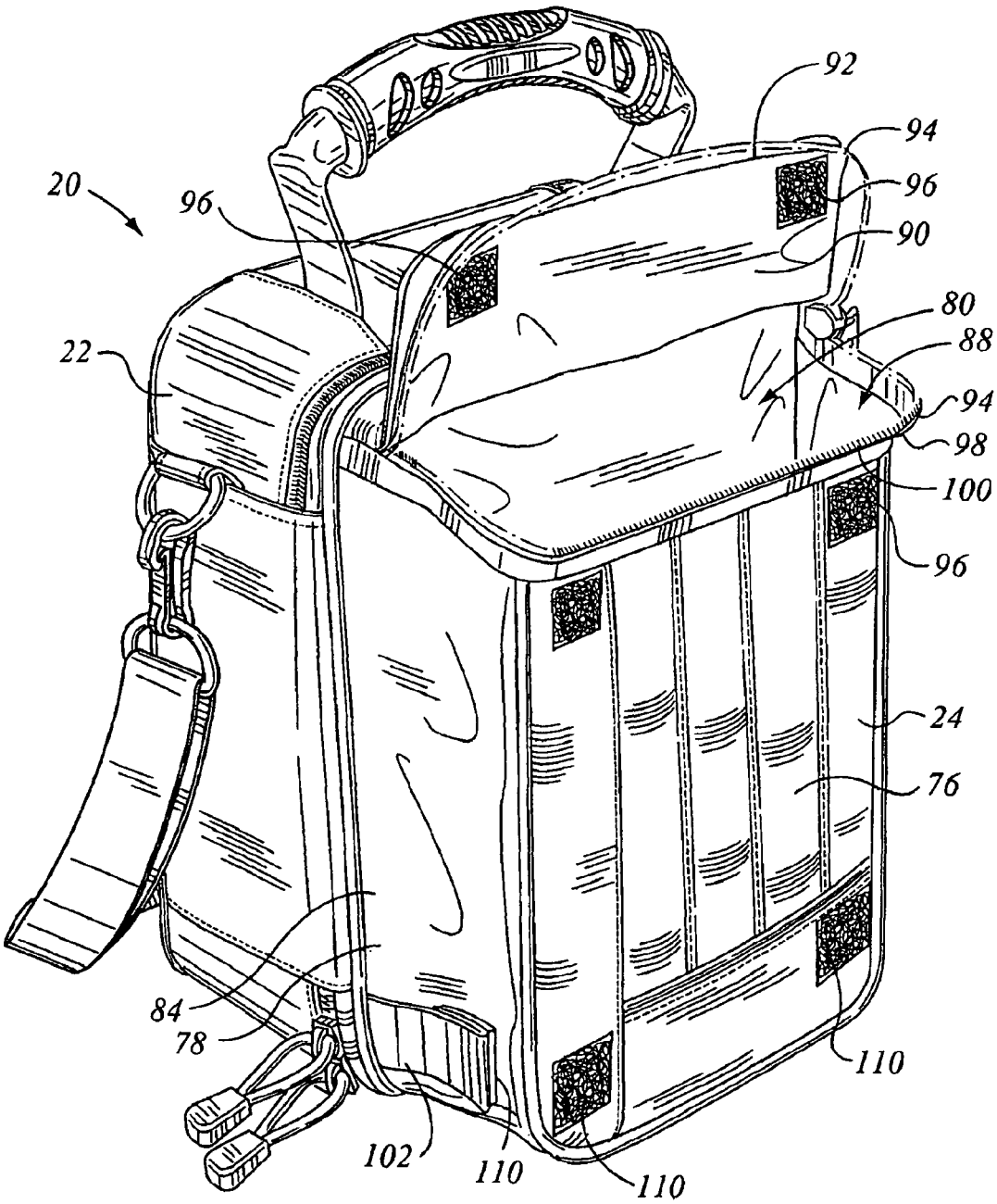
FIG. 2*g* shows the container of FIG. 2*a* in an open condition.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order to more clearly depict certain features of the invention.

For the purposes of this description, the largest panels of the bags herein described are arbitrarily designated as the front and rear sides, faces, or portions of the bag. Similarly, the closure member, or opening of the bag is arbitrarily designated as being at the top, and the base panel is designated as being at the bottom.

For the purposes of this description, it may be that a Cartesian frame of reference may be employed. In such a frame of reference, the long, or largest dimension of an object may be considered to extend in the direction of the x-axis, the base of the article, where substantially planar, may be considered to extend in an x-y plane, and the height of the article may be measured in the vertical, or z-direction. The largest panels of the containers described herein may be designated arbitrarily as the front and rear sides, faces, or portions of the container. Similarly, the closure member, or opening of the bag is arbitrarily designated as being at the top, and the base panel is designated as being at the bottom, as these terms may be appropriate for the customary orientation in which the objects may usually be found, sold, or employed, notwithstanding that the objects may be picked up and placed on one side or another from time to time at the user's choice. It should also be understood that, within the normal range of temperatures to which human food and human touch is accustomed, although the term cooler, or cooler container, or cooler bag, may be used, such insulated structures may generally also be used to keep food, beverages, or other objects either warm or hot as well as cool, cold, or frozen.

In this specification reference is made to insulated containers. The adjective "insulated" is intended to be given its usual and normal meaning as understood by persons skilled in the art. It is not intended to encompass single layers, or skins, of conventional webbing materials, such as Nylon™, woven polyester, canvas, cotton, burlap, leather, paper and so on, that are not otherwise indicated as having, or being relied upon to have, particular properties as effective thermal insulators other than in the context of being provided with heat transfer resistant materials or features beyond that of the ordinary sheet materials in and of themselves. Following from Phillips v. AWH Corp., this definition provided in the specification is intended to supplant any dictionary definition, and to prevent interpretation in the US Patent Office (or in any other Patent Office) that strays from the customary and ordinary meaning of the term "insulated" as provided herein.

Similarly, this description may tend to discuss various embodiments of soft-sided containers, as opposed to hard shell containers. In the jargon of the trade, a soft sided cooler, or bag, or container, is one that does not have a substantially rigid, high density exoskeleton (typically a molded shell, e.g., of ABS or polyethylene, or other common types of molded plastic). Rather, a soft-sided container may tend to have, for example, an outer skin, a layer of insulation, and an internal skin, both the internal and external skins being of some kind of webbing, be it a woven fabric, a nylon sheet, or some other membrane. The layer of insulation, which may be a sandwich of various components, is typically a flexible or resilient layer, perhaps of a relatively soft and flexible foam. A soft-sided container may still be a soft-sided container where, as described herein, it may include a substantially rigid liner, or may include one or more battens (which may be of a relatively hard plastic) concealed within the soft sided wall structure more generally, or where hard molded fittings may be used either at a container rim or lip, or to provide a base or a mounting point for wheels, but where the outside of the assembly is predominantly of soft-sided panels. Again, this definition is intended to forestall the US Patent Office, (or any other Patent Offices), from adopting an interpretation of the term "soft-sided" that diverges from the ordinary and customary meaning of the term as understood by persons of ordinary skill in the art in the industry, and as explained herein.

FIGS. 1*a* to 1*j* and 2*a* to 2*f* show an insulated container assembly 20. Insulated container assembly 20 may include a first insulated container portion 22, and a second insulated container portion 24.

First insulated container portion 22 may have the general form of a generally six-sided box, or enclosure, 26, having a first or rear panel 28, and a second, or front panel 30. First panel 28 and second panel 30 may be joined by an insulated wall structure in the nature of a peripheral wall 32 that extends about their respective peripheries and joins them together. To the extent that first panel 28 is of a generally rectangular form, which may in some embodiments have radiused corners as at 34, first panel 28 may have a pair of first and second generally opposed long sides or margins, 36, 38, and first and second generally opposed short sides, or margins, 40, 42. While, in the most general sense, first and second panels 28 and 30 may have generally planar forms, and may be polygons, and may be quadrilaterals, whether of equal or unequal size, or of the same or different profiles or footprints, it may often be convenient for first and second panels 28 and 30 to have substantially the same plan form profile or footprint, and for them to be spaced apart and parallel, such that the normal projection of one may lie upon, or substantially or predominantly upon, the other.

Peripheral wall 32 may include corresponding first and second long side portions 44, 46 and short side portions 48, 50, each of which may have a first or proximal margin joined to the corresponding marginal portion of the periphery of first panel 28, and may extend away from panel 28 to a distal margin such as may form a portion of the rim or periphery 52 with which second panel 30 may cooperate.

The structure thus described may tend to define a thermally insulated internal space, or cavity, or accommodation, indicated generally as 54. Access to accommodation 54 may be obtained by mounting second panel 30 in a movable condition, such that second panel 30 may move between an open condition (FIG. 1*i*) and a closed condition (FIG. 1*a*) with respect to peripheral wall 32, and, indeed, with respect to accommodation 54 more generally. To this end, second panel 30 may be pivotally or hingedly mounted to peripheral wall 32, and, in particular, may have a long side margin 56 that is hingedly mounted to a corresponding long side margin portion, be it 58 of, for example, long side 44, such that second panel 30 may swing in the manner of a door, or first closure, operable to govern access to accommodation 54. In this structure, the long or lengthwise overall dimension L may tend to be greater than the breadthwise dimension W, each of which may tend to be greater than the depth or thickness T measured normal to first and second panels 28, 30. Indeed, L may tend to be in the range of 1:1 to 2:1 times W, and may tend to be in the range of 2 to 5 times T. In one embodiment, the ratio of proportions L:W:T may be roughly 5:4:2, (all +/−30%). In a typical embodiment, container assembly 20 may tend to be employed as a lunch box.

The container assembly 20 may include a securement in the nature of a releasable fitting 60, such as may be operable to retain the closure member, e.g., panel 30, in the closed position. Fitting 60 may be a friction fit, or interference fitting or bead, or lip, which may either be discrete or which may run in a substantially continuous manner about a portion or all of the rim 52 of peripheral wall 32. In one embodiment, fitting 60 may include mating hook and eye attachment fittings (of which one type is sold under the name Velcro™), or it may be in the nature of a tracked fastener, of which one type is a zipper 64. In one embodiment, zipper 64 may extend about those portions of rim 52 not connected by hinge 66, namely the opposite long side margin and the two short side margins. Hinge 66 may be in the nature of a living or fabric hinge or flap, as may be.

Container assembly 20 may include a liner, 70. Liner 70 may be a flexible liner that may be attached about rim 52, and may be on the inside thereof completely within the enclosure. Liner 70 may be a seamless folded liner made of vinyl sheet stock, and may be translucent, or see-through. Liner 70 may be invertible and washable. Liner 70 may be permanently installed, as by sewing around the periphery at rim 52, or it may be removably installed, as by a tracked fastener, such as a zipper, or by Velcro™ 72 as may be. Alternatively, liner 70 may be a "hard body" liner, such as the substantially rigid, liner described below. Second panel 30 may have a retainer 74 mounted on the inside thereof, such as may sometimes be used to hold a coding or heating member, such as a chemical freezer pack or ice pack.

Second insulated container portion 24 may be mounted to the front face of second panel 30 of first insulated container portion 22. It may be that second insulated container portion 24 includes a separate backing wall, or it may be that second panel 30 serves both as the front wall of first insulated container portion 22 and as the back wall of second insulated container portion 24, providing a common insulated wall between them such as may tend to permit the two insulated container portions to be kept at different temperature or humidity condition (or both).

Second insulated container portion 24 may include an insulated wall structure having a main or front panel 76, and a sidewall 78 that may extend about a portion or all of the periphery of main panel 76 and second panel 30. Front panel 76, sidewall 78 and second panel 30 may co-operate to define a second lodgement, enclosure, space, volume, or accommodation 80. Front panel 76 may have a generally rectangular plan form profile or footprint, that may correspond generally to the plan form or profile of second panel 30, whether it be of the same size or be slightly smaller or larger. Sidewall 78 may include a bottom portion 82, and a pair of side portions 84, 86, which may form a generally U-shaped periphery, leaving an opening 88 at one end, that end being arbitrarily designated a top end.

Second insulated container portion 24 may also have a closure member, 90, that is movable between an open and a closed position, and that is thereby operable to govern access to accommodation 80. In one embodiment, closure member 90 may be a lid of flap 92, which may be hingedly attached along a portion of the peripheral margin on second panel 30. It may be that flap 92 extends along or near to one of the short sides of second panel 30. Flap 92 may have two attachment or securement fittings, a first fitting 94 for securing flap 92 when second insulated container portion 24 is in an expanded position, as in FIG. 2*a*, and a second fitting 96 for use when second insulated container portion 24 is in a collapsed position as shown in FIG. 1*a*. First fitting 94 may be a tracked fastener, such as a zipper 98, that runs about the rest of the lip 100 of the wall structure of second container portion 24, opposite to the hinged margin of flap 92. Second insulated container portion 24 may have further securement fittings, or retainers, 102, such as may be employed to hold a portion of second insulated container portion 24 in the collapsed position of FIG. 1*a*. In one embodiment, retainers 102 may be straps 104 having a first end 106, such as may be mounted to a side face of first insulated container portion 22 fixedly; and a second end 108 that may be releasably attached to a mating fitting, or fittings, 110, mounted to the front face of main panel 76, near bottom portion 82. Second end 108 may be releasably attached in a first position corresponding to the collapsed position of FIG. 1*a*, and in a second position corresponding to the expanded position of FIG. 2*a*.

Insulated container assembly 20 may include a lifting member 112 such as may be attached at one or more locations such that when insulated container assembly 20 is suspended from lifting member 112, flap 92 may tend to be uppermost relative to the remainder of second insulated wall portion 24 generally, and bottom portion 82 in particular. As such, when being carried, objects may tend not to fall out of second accommodation 80. In one embodiment, lifting member 112 may have the form of a handle 114 mounted to topmost short side end wall portion 50 of peripheral wall 36. Insulated container assembly 20 may also include a second lifting member, in the nature of a shoulder strap 116 and shoulder strap fittings 118, which may be located near the uppermost end of long side portions 44, 46, such that container assembly 20 may be carried over a user's shoulder.

Alternately or optionally, insulated container assembly 20 may include an auxiliary accommodation 124 mounted externally to accommodations 54 and 80. Auxiliary accommodation 124 may have an insulated wall structure, or may have a non-insulated retaining lodgement, such as may include a base member 126, which, in one embodiment may be rounded in a manner such as to support a round beverage or other container and a web or net 128 with a hemmed upper margin, such as may accommodate a drink bottle, or the like. When not in use, base member 126 may flip up against on of the sidewall portions of peripheral wall 32 more generally. It may be that accommodation 124 is mounted to one of the long side portions of peripheral wall 32, and base member 126 may be oriented to be located closer to bottom portion 82, and the opening or accommodation 124 may be oriented in the upper or uppermost direction, generally toward flap 92.

Insulated container assembly 20 may be a soft sided insulated container assembly, in which the wall structure may typically include an outer layer or skin 130, an internal layer (or layers) of insulating material 132, and an inner layer or skin 134. Insulating material 132 may itself be a sandwich of insulating layers or sub layers, such as a closed cell foam layer, 136, an open cell foam layer 138, and a closed cell foam layer 140. It may be that the outer layer, 130, may tend to be made of a relatively wear resistant material, be is a woven polyester material or some other. The internal layer may be a sheet of Nylon, and may have a reflective inner surface. Optionally, one or more panels may have stiffening battens mounted therein, e.g., it may be desired that first panel 28 or short side end panel 48 be stiffened for suitability as a base upon which to rest insulated container assembly 20, either when resting in the opened position of FIG. 1*i* or when standing in the closed position of FIG. 2*a*. In that case, either may include a reinforcement, or stiffener, such as may be identified as stiffening batten 142

Insulated container assembly 20 may also have a third lifting or securing number 144 such as may be mounted to the new or back or base wall, namely panel 28, and which may be in the nature of a cinch strap 146. Cinch strap 146 may be employed releasably to attach container assembly 20 to another object, such as a carrier on a bicycle, sometimes referred to as a rat-trap carrier, or for fastening to a knap sack or to a belt.

When employed as a lunch box, container assembly 20 may stand on short side end face 48, with the second insulated container portion 24 in an upright orientation. At lunchtime, or at such time as required, the beverage (if any) may be removed, and the case may be laid on its back, and the front panel, i.e., second panel 30, opened to provide access to accommodation 54. This arrangement may be facilitated by the placement of the hinge of second panel 30 along one side of panel 30, and the hinge of flap 92 along another side, which may be an adjacent side.

In another embodiment, in FIGS. 3*a*-3*j*, a soft sided insulated container 220 may include a first insulated container portion 222, and a second insulated container portion 224.

First insulated container portion 222 may have the general form of a generally six-sided box, or enclosure, 226, having a first or bottom panel 228, and a second, or top panel 230. First panel 228 and second panel 230 may be joined by an insulated wall structure in the nature of a peripheral wall 232 that extends about their respective peripheries and joins them together. To the extent that first panel 228 is of a generally rectangular form, which may in some embodiments have radiused corners, first panel 228 may have a pair of first and second generally opposed long sides or margins, 236, 238, and first and second generally opposed short sides, or margins, 240, 242. While, in the most general sense, first and second panels 228 and 230 may have generally planar forms, and may be polygons, and may be quadrilaterals, whether of equal or unequal size, or of the same or different profiles or footprints, it may often be convenient for first and second panels 228 and 230 to have substantially the same plan form profile or footprint, and for them to be spaced apart and parallel, such that the normal projection of one may lie upon, or substantially or predominantly upon, the other.

Peripheral wall 232 may include corresponding first and second long side portions 244, 246 and short side portions 248, 250, each of which may have a first or proximal margin joined to the corresponding marginal portion of the periphery of first panel 228, and may extend away from panel 228 to a distal margin such as may form a portion of the rim or periphery 252 with which second panel 230 may cooperate.

The structure thus described may tend to define a thermally insulated internal space, or cavity, or accommodation, indicated generally as 254. Access to accommodation 254 may be obtained by mounting second panel 230 in a movable condition, such that second panel 230 may move between an open condition and a closed condition with respect to peripheral wall 232, and with respect to accommodation 254 more generally. To this end, second panel 230 may be pivotally or hingedly mounted to peripheral wall 232, and, in particular, may have a long side margin 256 that is hingedly mounted to a corresponding long side margin portion, of back long side portion 246 of peripheral wall 232, such that second panel 230 may swing in the manner of a door, or first closure, operable to govern access to accommodation 254. In this structure, the long or lengthwise overall dimension L may tend to be greater than the breadthwise dimension W. In this embodiment, the depth, D, may be of comparable magnitude to length L measured normal to first and second panels 28, 30. L may tend to be in the range of 5:4 to 3:1 times W, and may tend to be in the range of 2/3 to 3/2 times D. In one embodiment, the ratio of proportions L:W:D may be roughly 2:1:2, (all +/−30%). In a typical embodiment, container assembly 220 may tend to be employed as a beverage cooler and picnic lunch box.

Container assembly 220 may include a securement in the nature of a releasable fitting 260, such as may be operable to retain the closure member, e.g., panel 230, in the closed position. Fitting 260 may be a friction fit, or interference fitting or bead, or lip, which may either be discrete or which may run in a substantially continuous manner about a portion or all of the rim 252 of peripheral wall 232. In one embodiment fitting 260 may include mating hook and eye attachment fittings (of which one type is sold under the name Velcro,™), or it may be in the nature of a tracked fastener, of which one type is a zipper 264. In one embodiment, zipper 264 may extend about those portions of rim 252 not connected by hinge 266, which may be the opposite long side margin and the two short side margins. Hinge 266 may be in the nature of a living or fabric hinge or flap, as may be.

Container assembly 220 may include a liner, 270. Liner 270 may be a flexible liner that may be attached about rim 252, and may be on the inside thereof completely within the enclosure. Liner 270 may be a seamless folded liner made of vinyl sheet stock, and may be translucent, or see-through. Liner 270 may be invertible and washable. Liner 270 may be permanently installed, as by sewing around the periphery at rim 252, or it may be removably installed, as by a tracked fastener, such as a zipper, or by Velcro™ as may be. Alternatively, liner 270 may be a "hard body" liner, and may be substantially rigid. That is, liner 270 may be a molded plastic part, of relatively high density, be it of nylon or some other suitable material, and which may tend to be substantially stiffer than the soft sided insulated wall structure by which it is surrounded. In such a case, liner 270 may serve to discourage crushing of objects carried within first insulated container portion 222, and yet still obtain the benefit of the thermal insulation of the wall blanket, namely that of the walls of first insulated wall portion 222. Further, liner 270 may have a flanged rim, as at 266, that when installed may seat immediately adjacent, and inside, rim 252 of peripheral sidewall 232.

Second insulated container portion 224 may be mounted to the front face of first insulated container portion 222, namely the face of long side wall portion 244. It may be that second insulated container portion 224 includes a separate backing wall, or it may be that sidewall portion 244 serves both as the front wall of first insulated container portion 222 and as the back wall of second insulated container portion 224, providing a common insulated wall between them such as may tend to permit the two insulated container portions to be kept at different temperature or humidity condition (or both).

Second insulated container portion 224 may include an insulated wall structure having a main or front panel 276, and a sidewall 278 that may extend about a portion or all of the periphery of main panel 276 and second or front wall panel 244. Front panel 276, sidewall 278 and second panel 244 may co-operate to define a second lodgement, enclosure, space, volume, or accommodation 280. Front panel 276 may have a generally rectangular plan form profile or footprint, that may correspond generally to the plan form or profile of second panel 244, whether it be of the same size or be slightly smaller or larger. Sidewall 278 may include a bottom portion 282, and a pair of side portions 284, 286, which may form a generally U-shaped periphery, leaving an opening 288 at one end, that end being arbitrarily designated a top end.

Figure 3A:
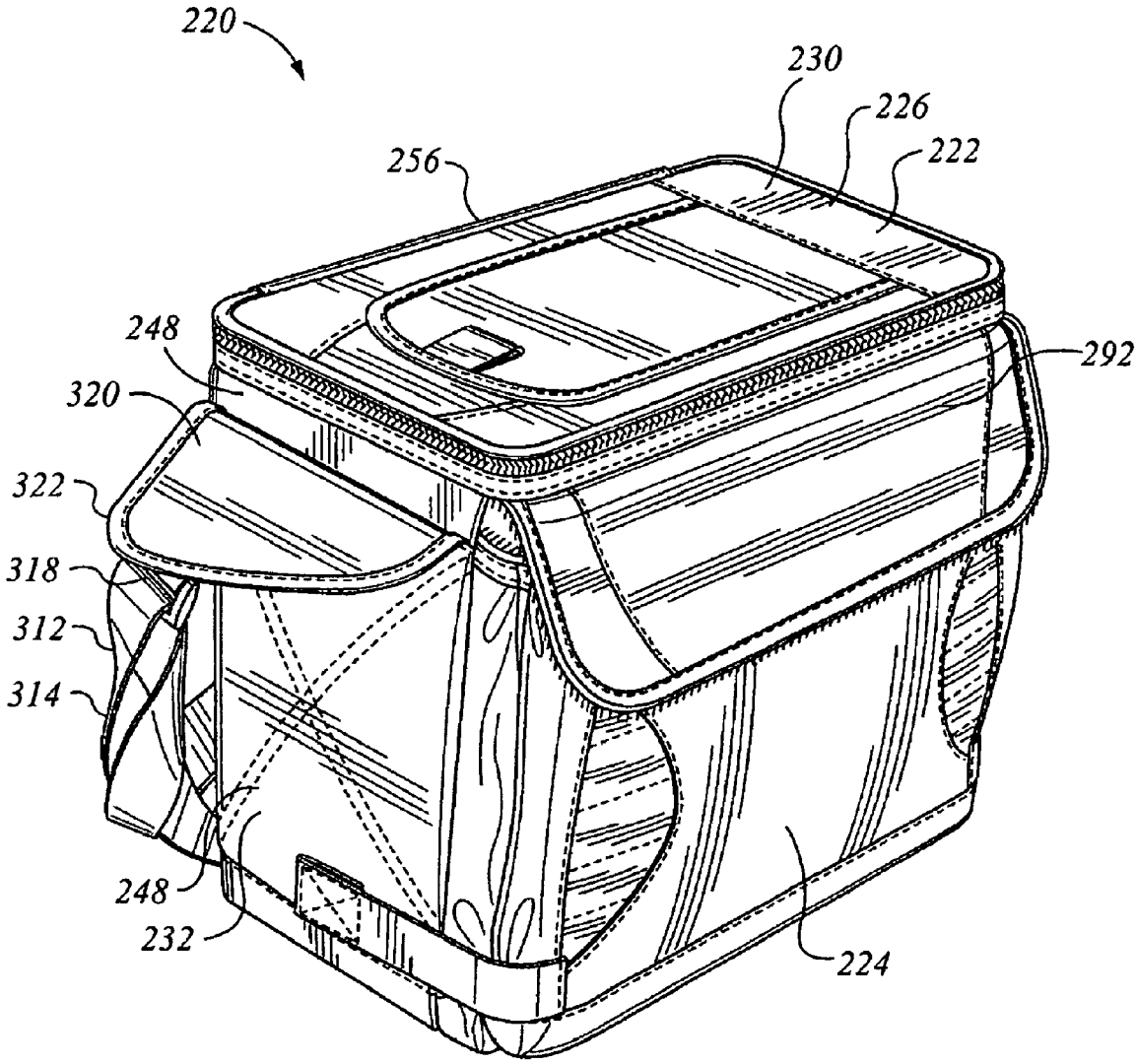
FIG. 3*a* shows an isometric view from in front, above and to one corner of an alternate embodiment of an insulated container to that of FIG. 1*a;*
Figure 3B:
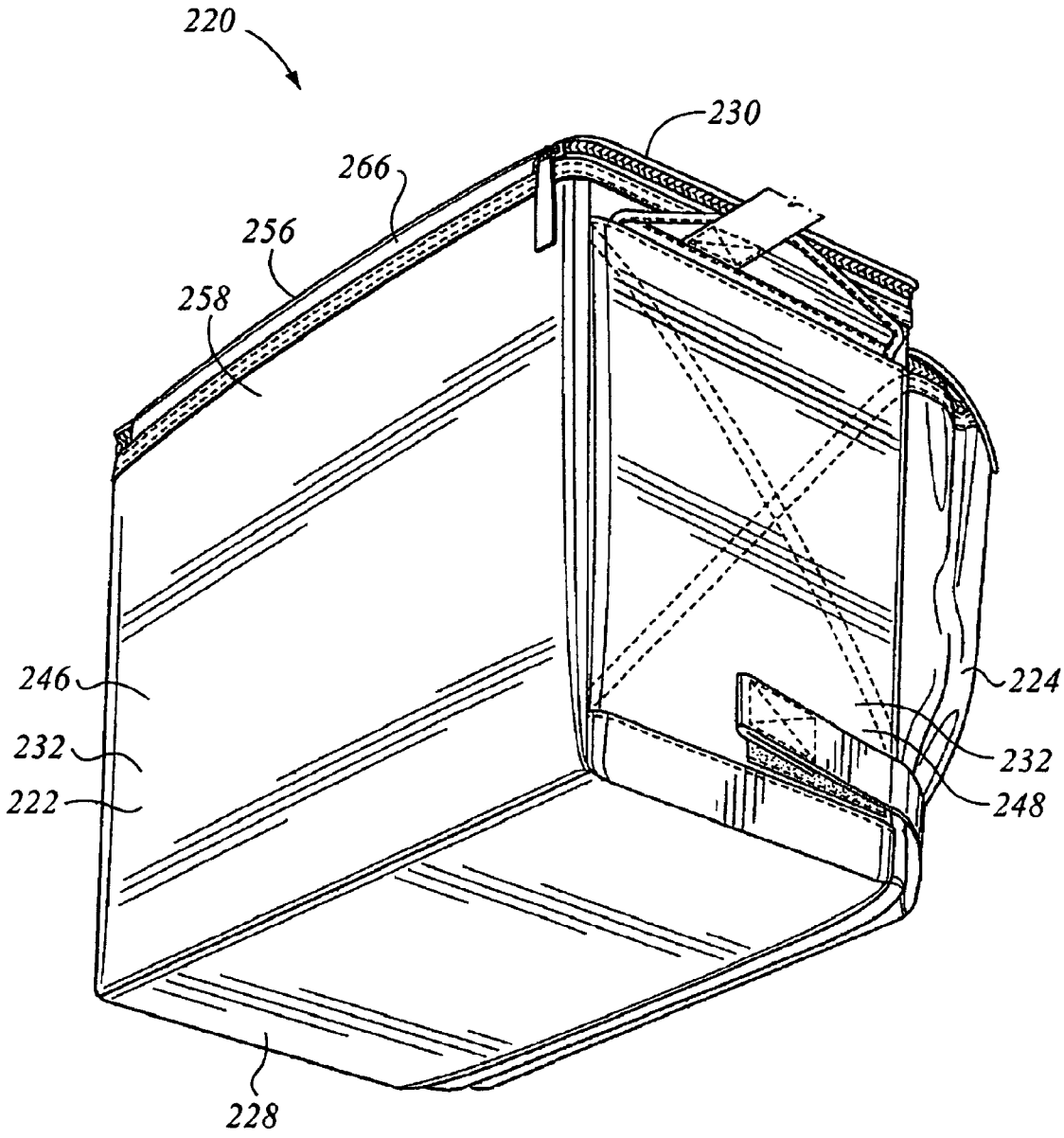
FIG. 3*b* is an opposite isometric view of the container of FIG. 3*a;*
Figure 3C:
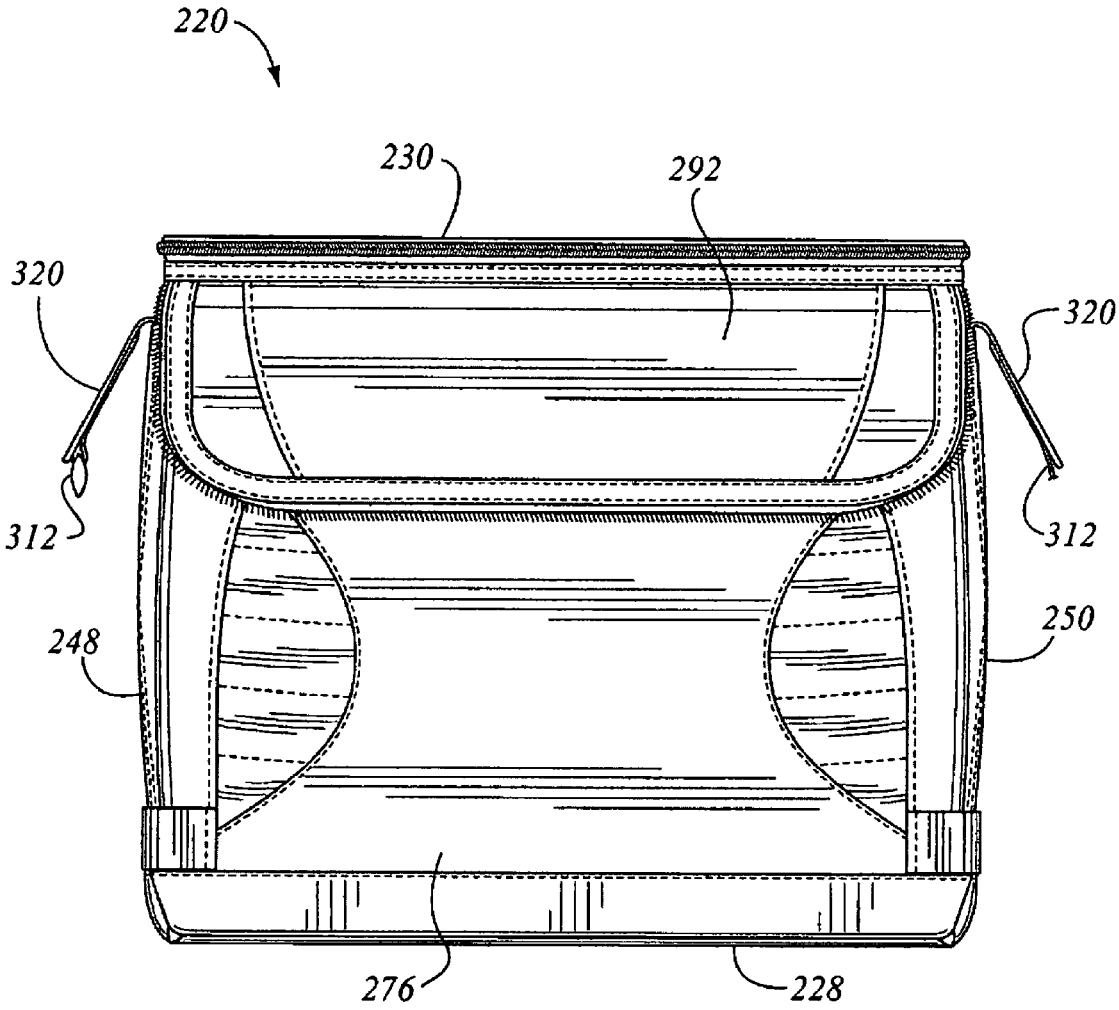
FIG. 3*c* is a front view of the container of FIG. 3*a;*
Figure 3D:
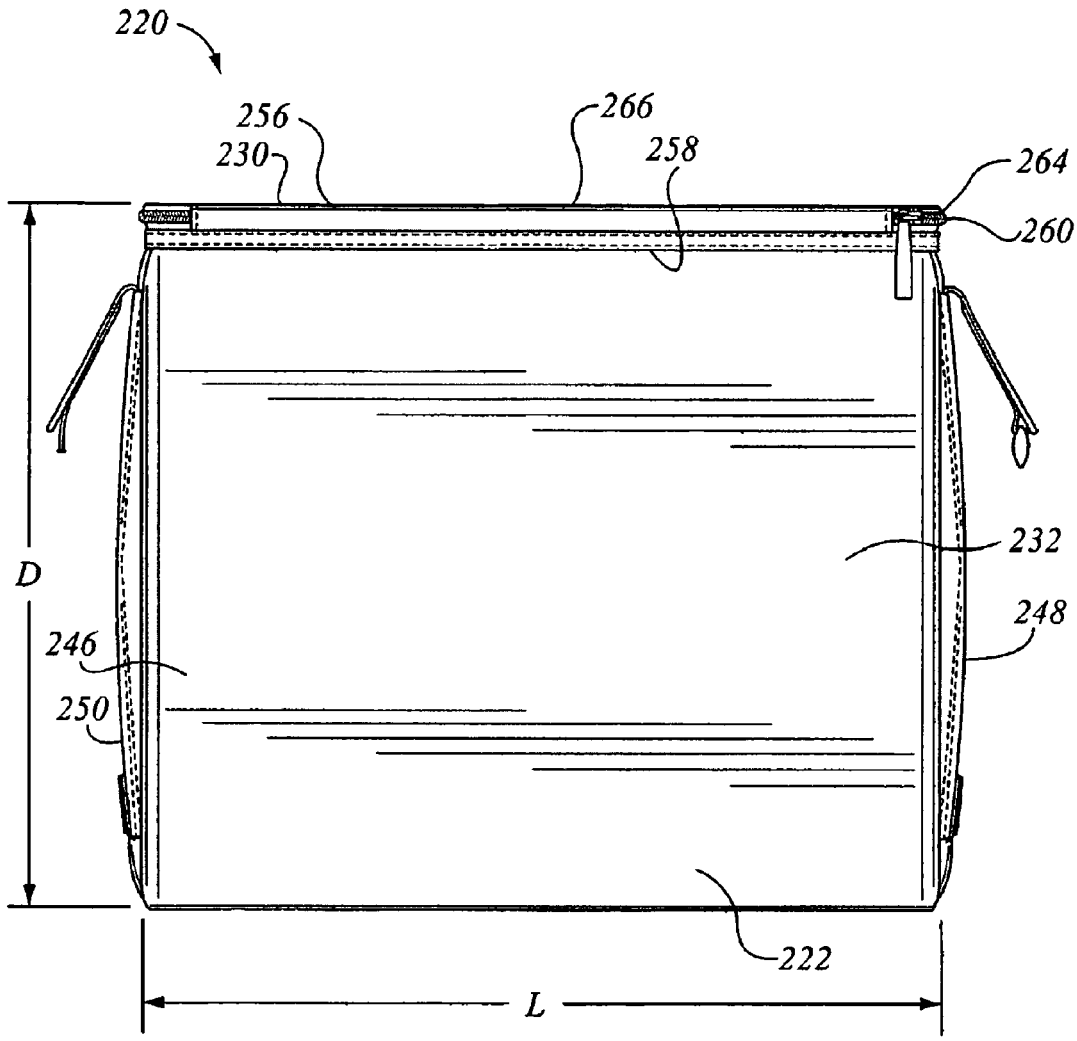
FIG. 3*d* is a rear view of the container of FIG. 3*a;*
Figure 3E:
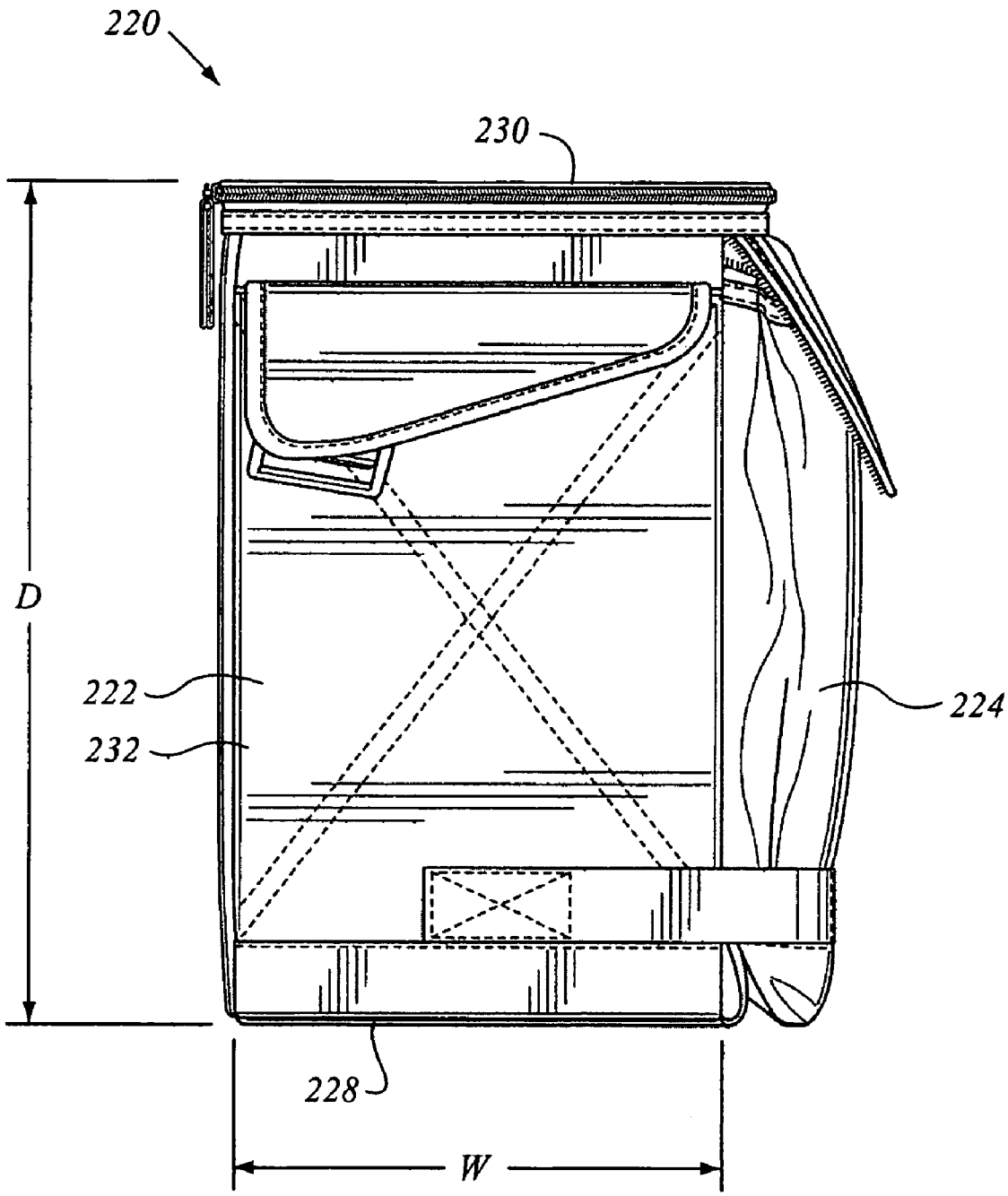
FIG. 3*e* is a left hand end view of the container of FIG. 3*a;*
Figure 3F:
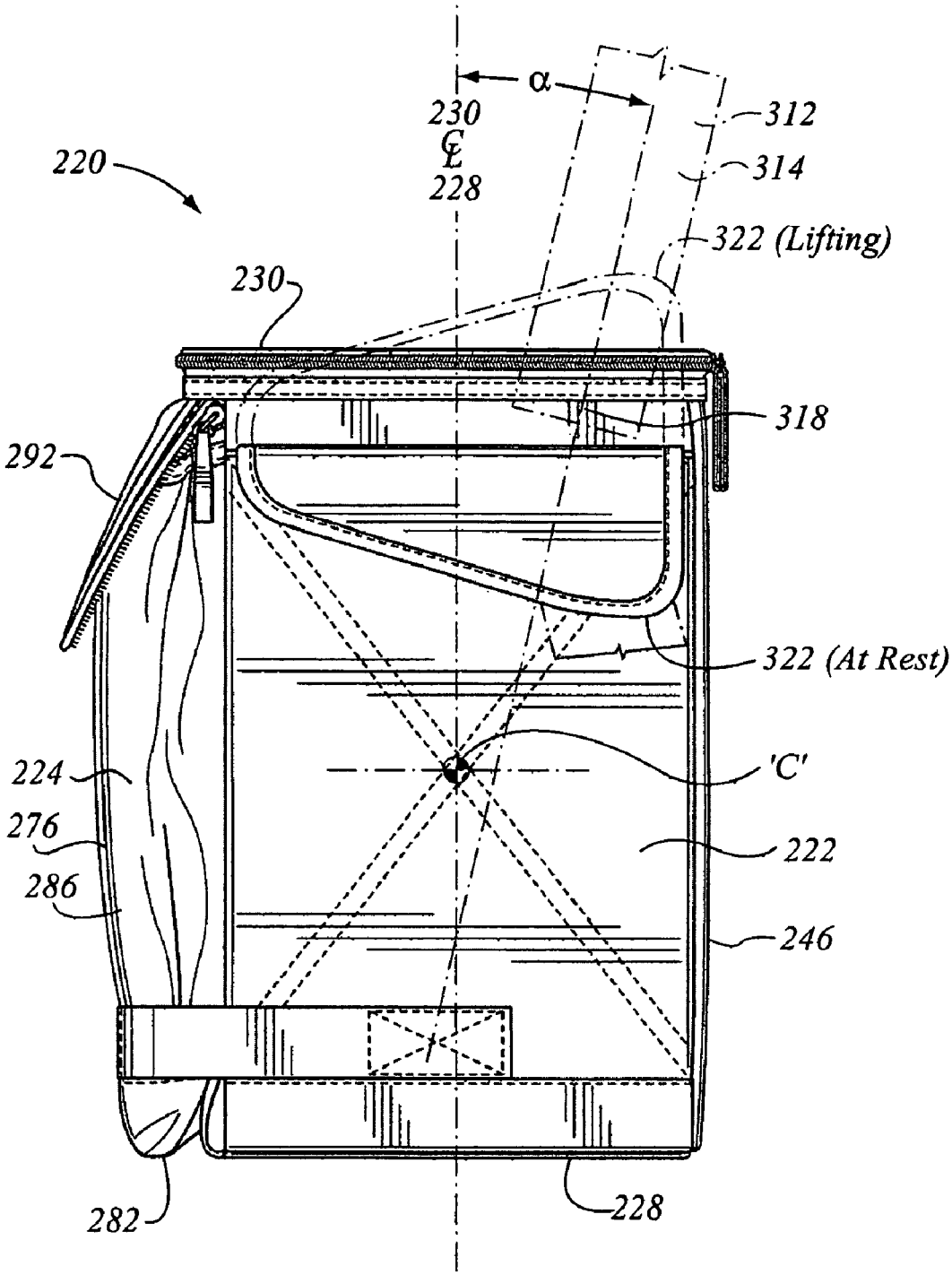
FIG. 3*f* is a right hand end view of the container of FIG. 3*a;*
Figure 3G:
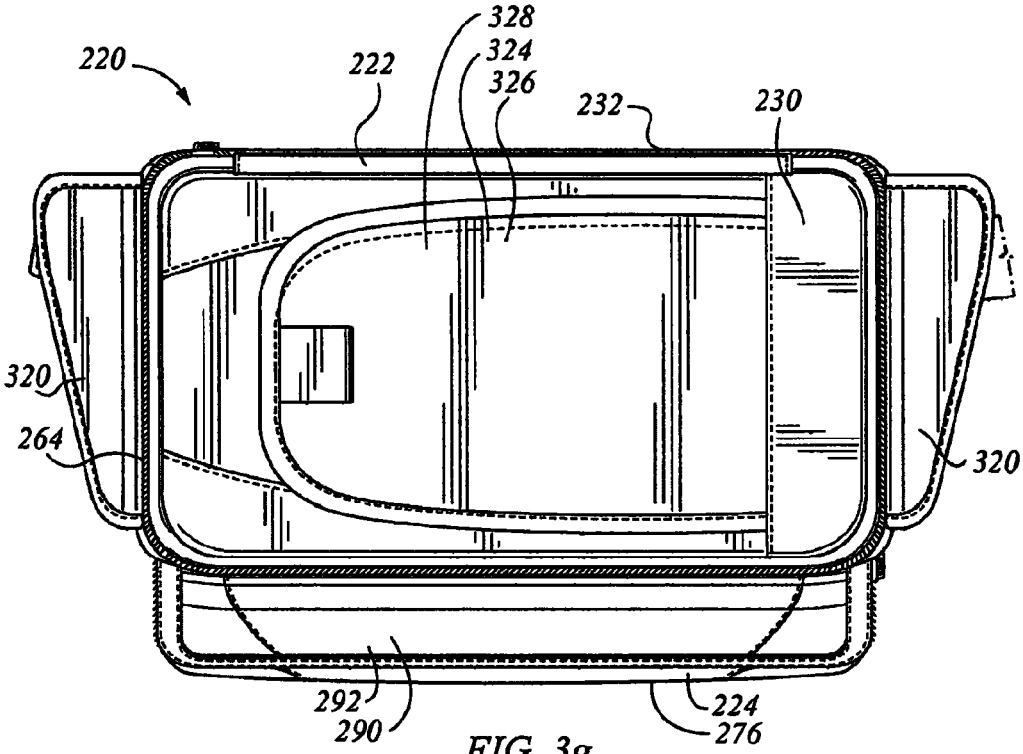
FIG. 3*g* is a top view of the container of FIG. 3*a* in a closed condition.
Figure 3H:
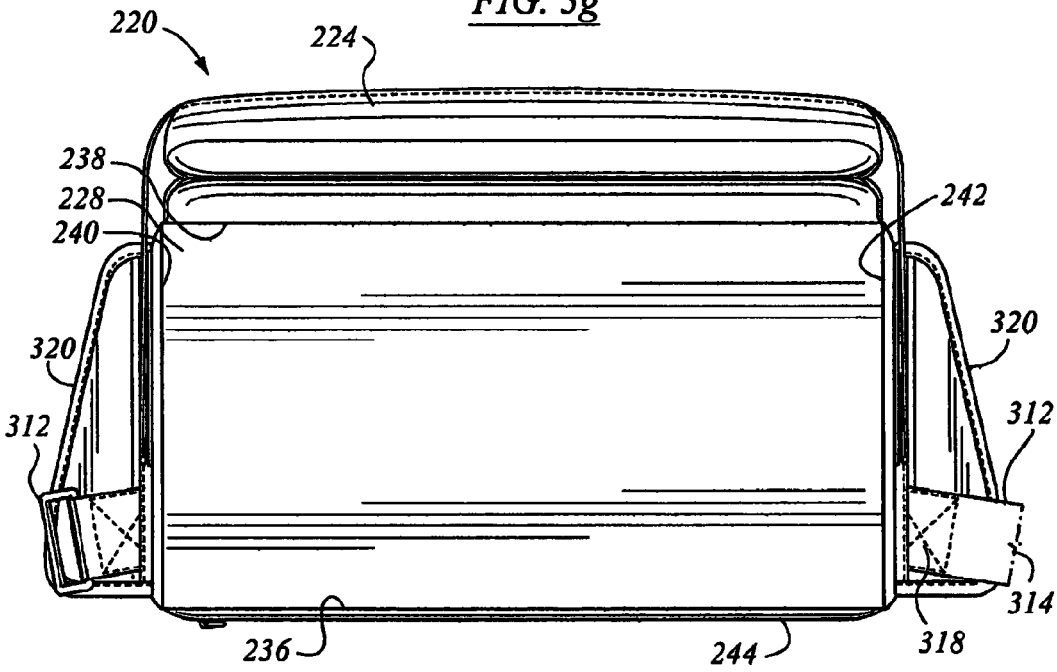
FIG. 3*h* is a bottom view of the container of FIG. 3*a;*
Figure 3I:
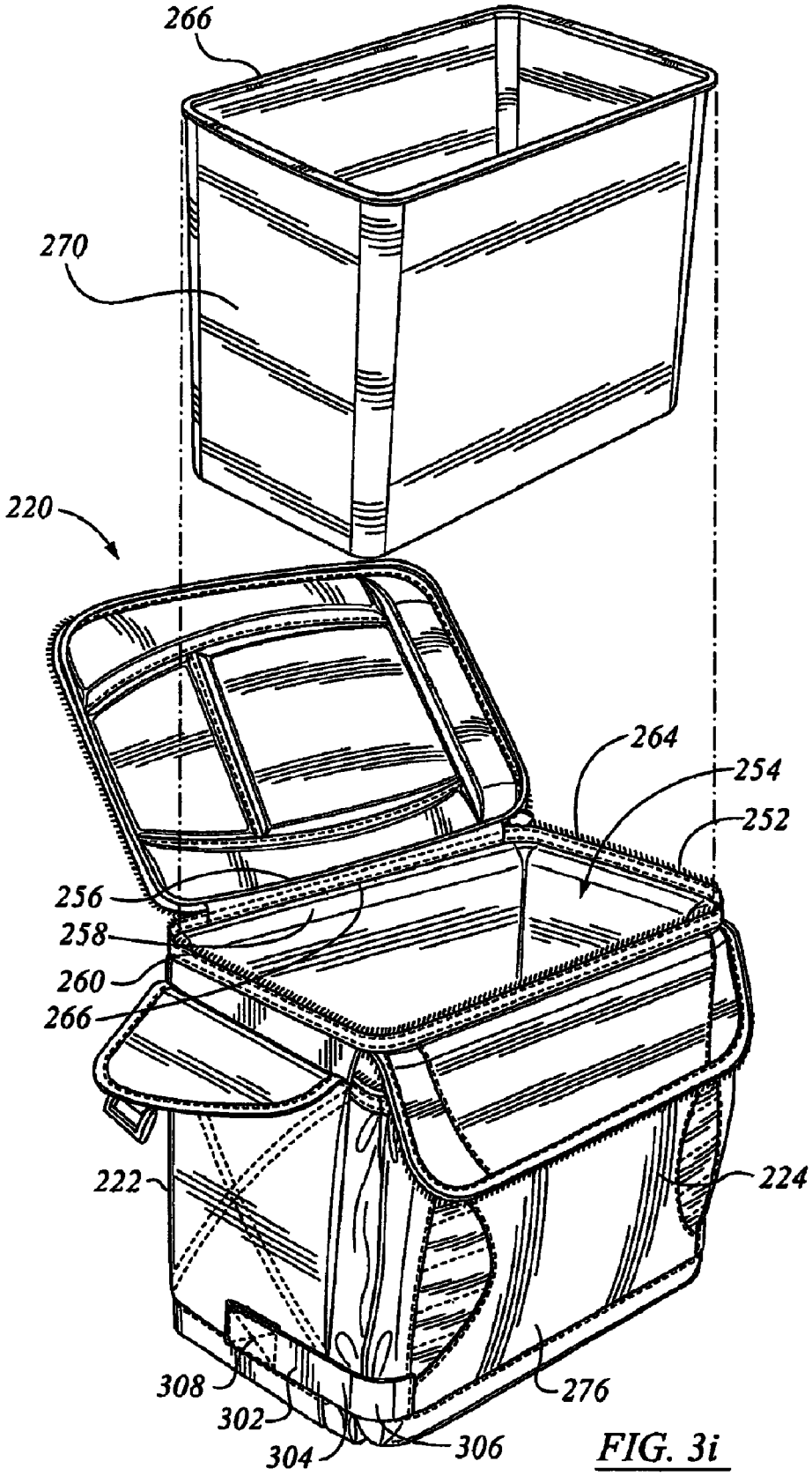
FIG. 3*i* is a view of the container of FIG. 3*a* in an open condition.
Figure 4A:
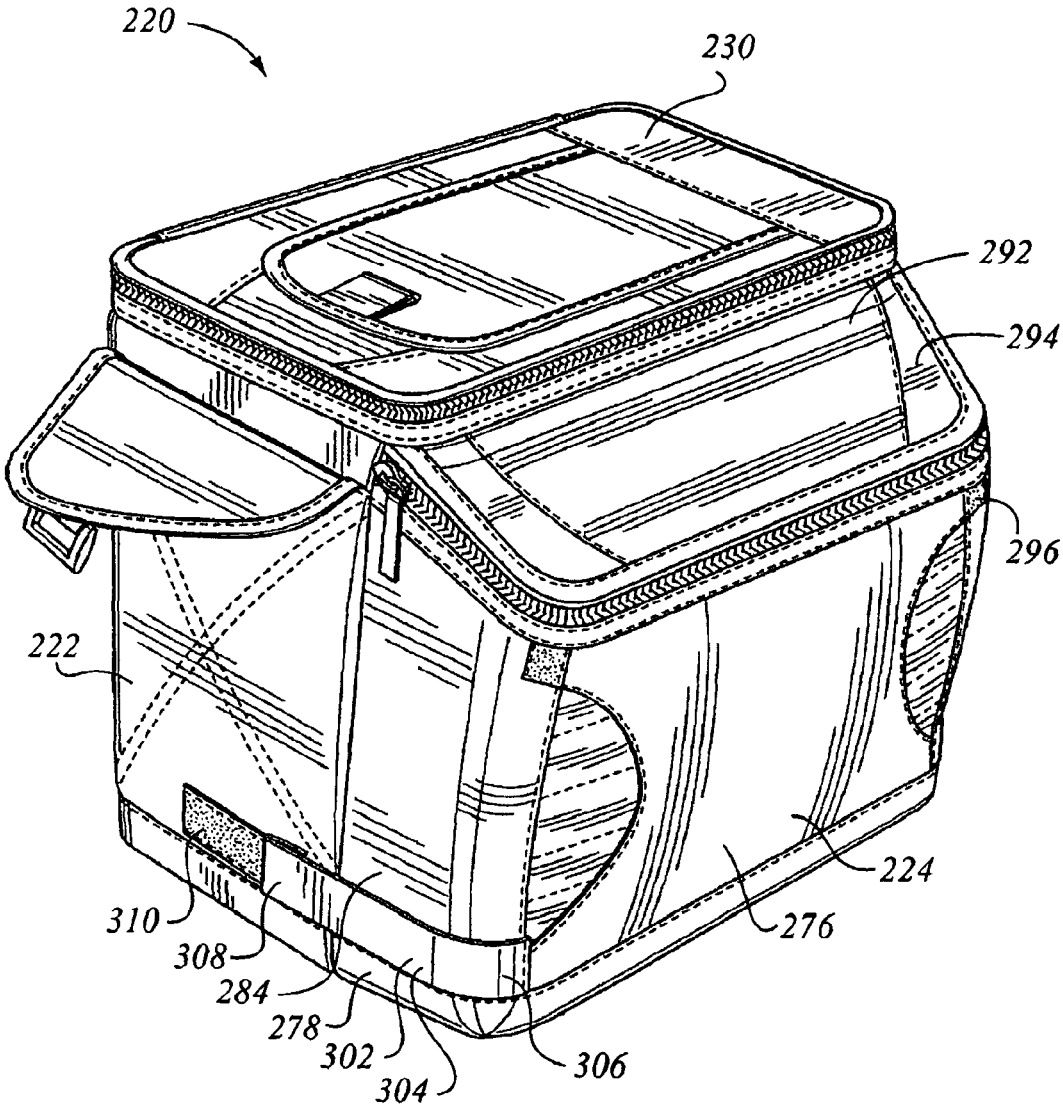
FIG. 4*a* is an isometric view of the container of FIG. 3*a* in an expanded condition.
Figure 4B:
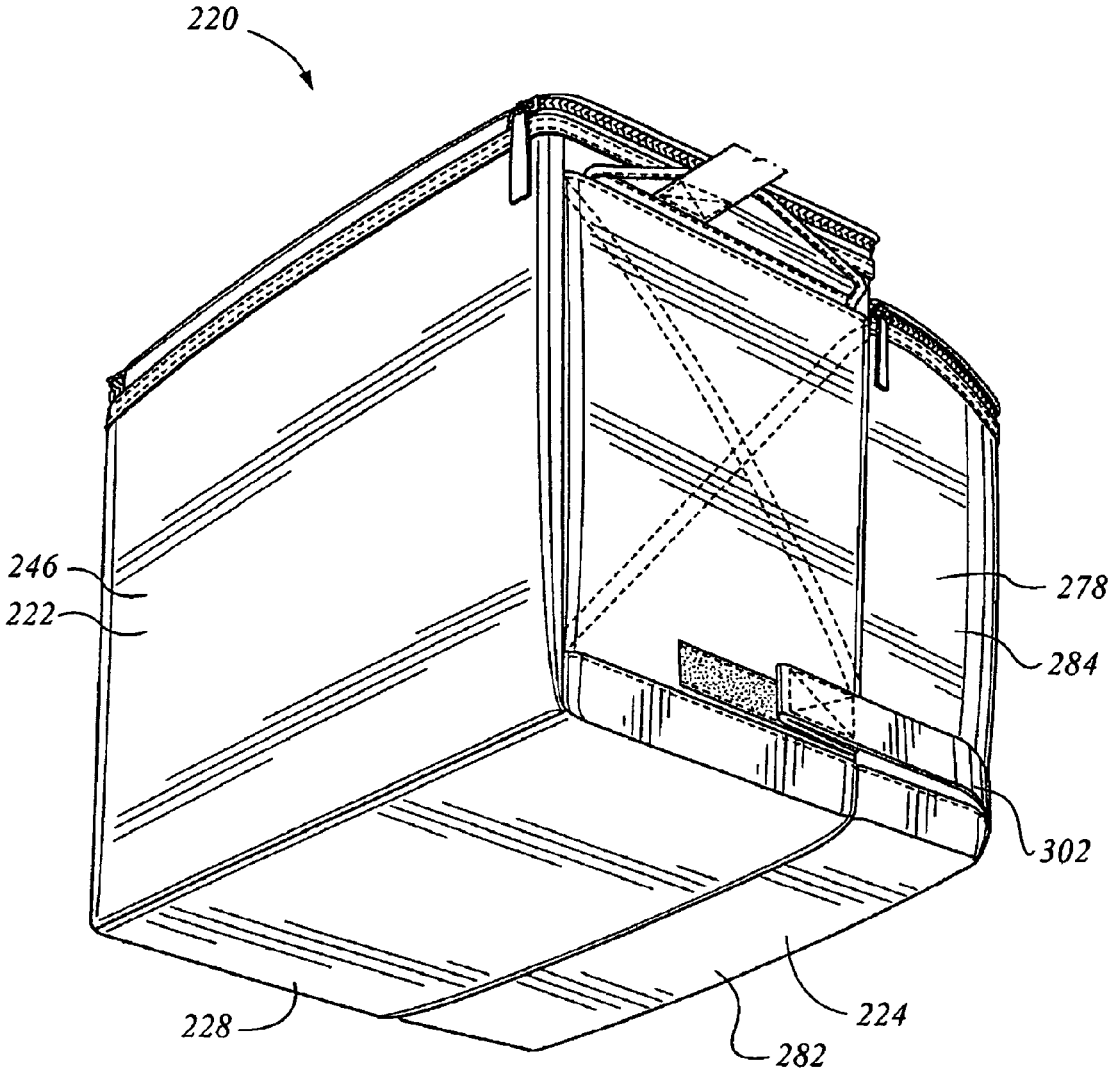
FIG. 4*b* is another isometric view of the container of FIG. 4*a* from behind and below.
Figure 4C:
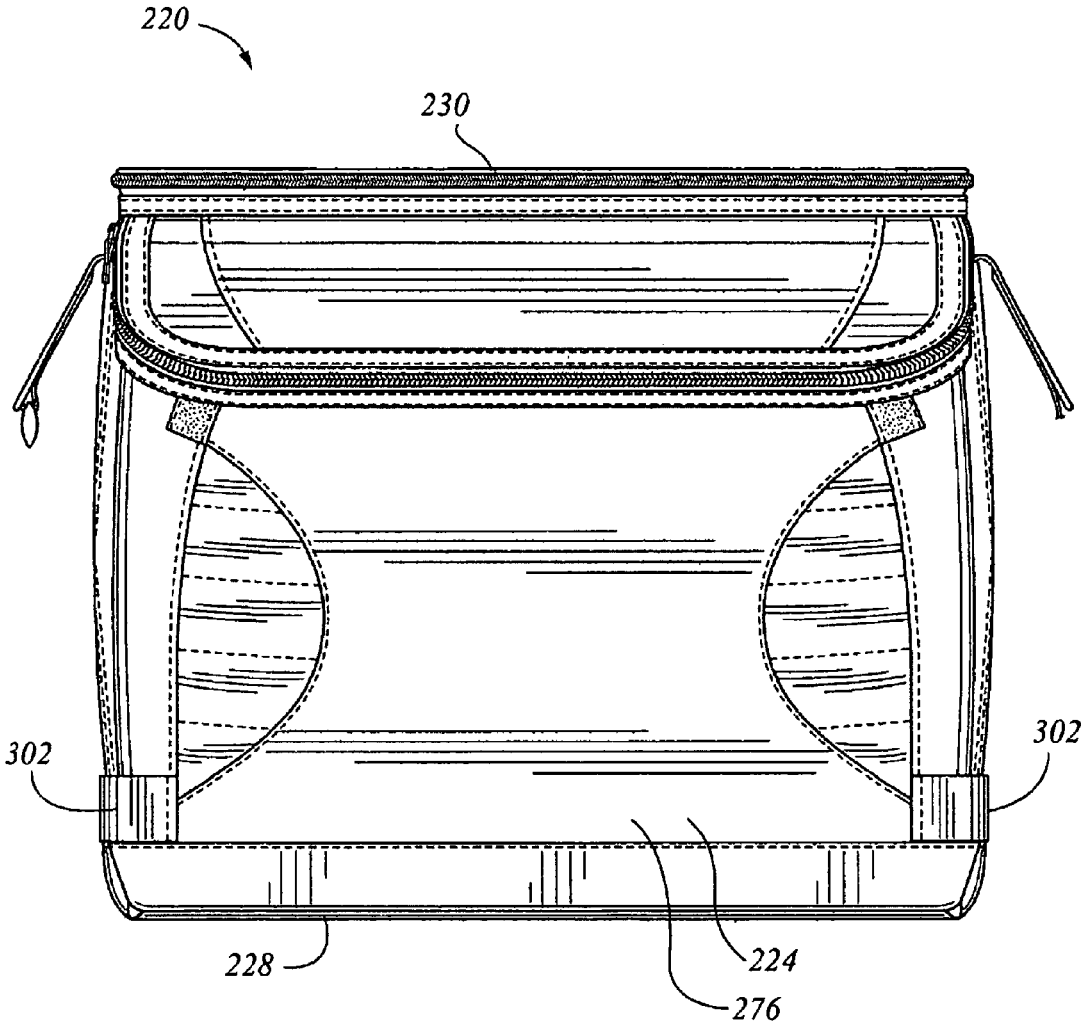
FIG. 4*c* is a front view of the container of FIG. 4*a;*
Figure 4D:
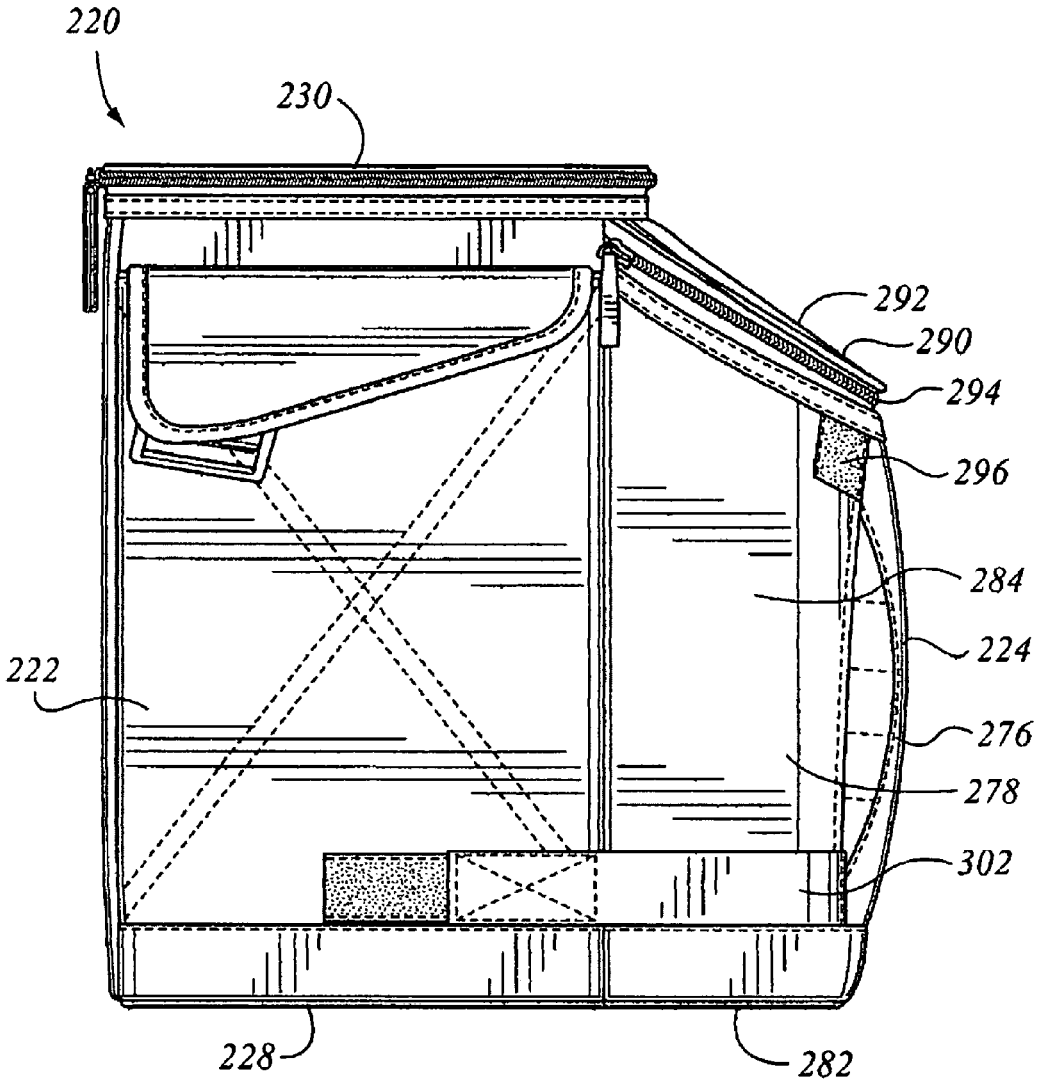
FIG. 4*d* is a left hand side view of the container of FIG. 4*a;*
Figure 4E:
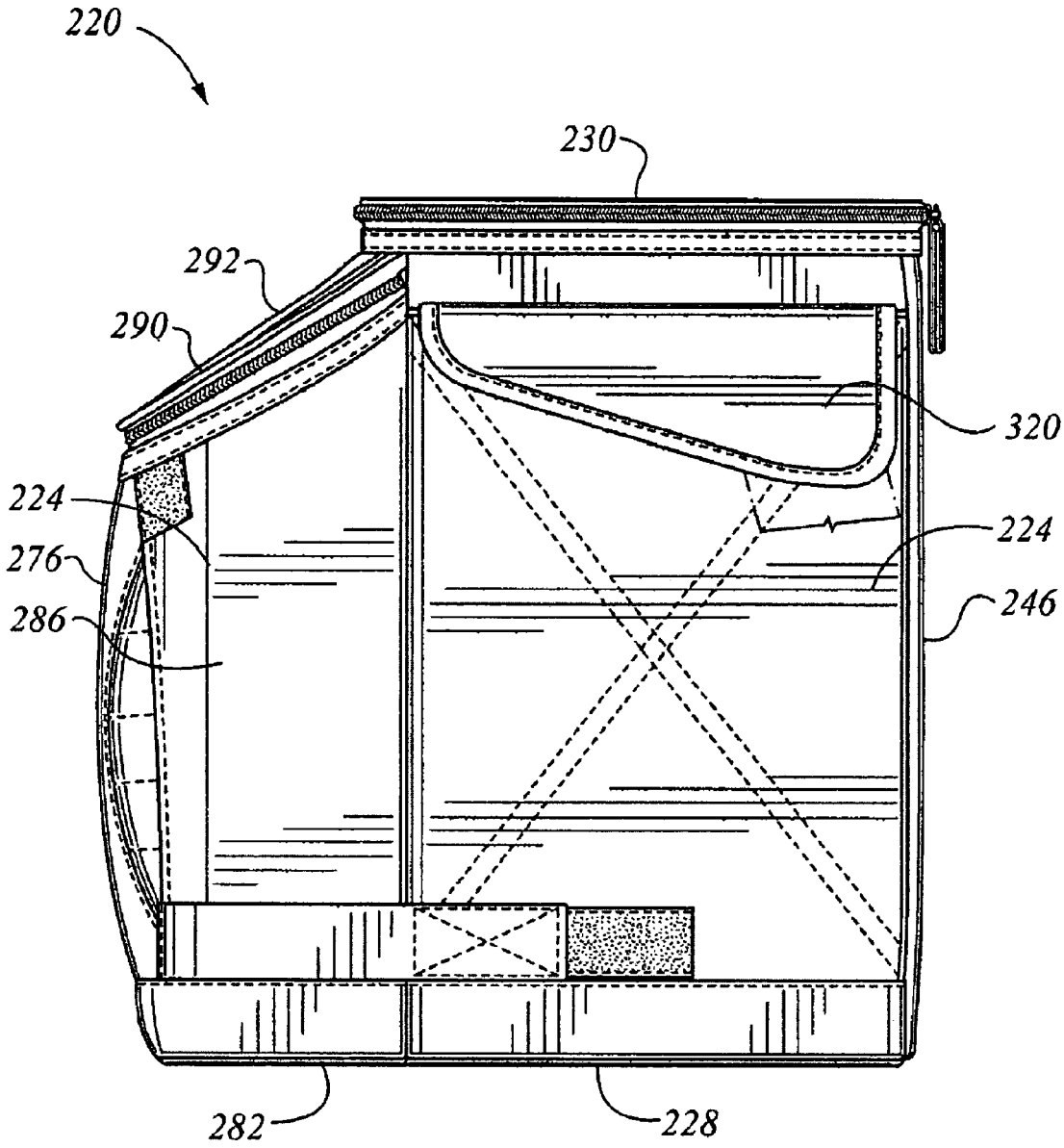
FIG. 4*e* is a right hand side view of the container of FIG. 4*a;*
Figure 4F:
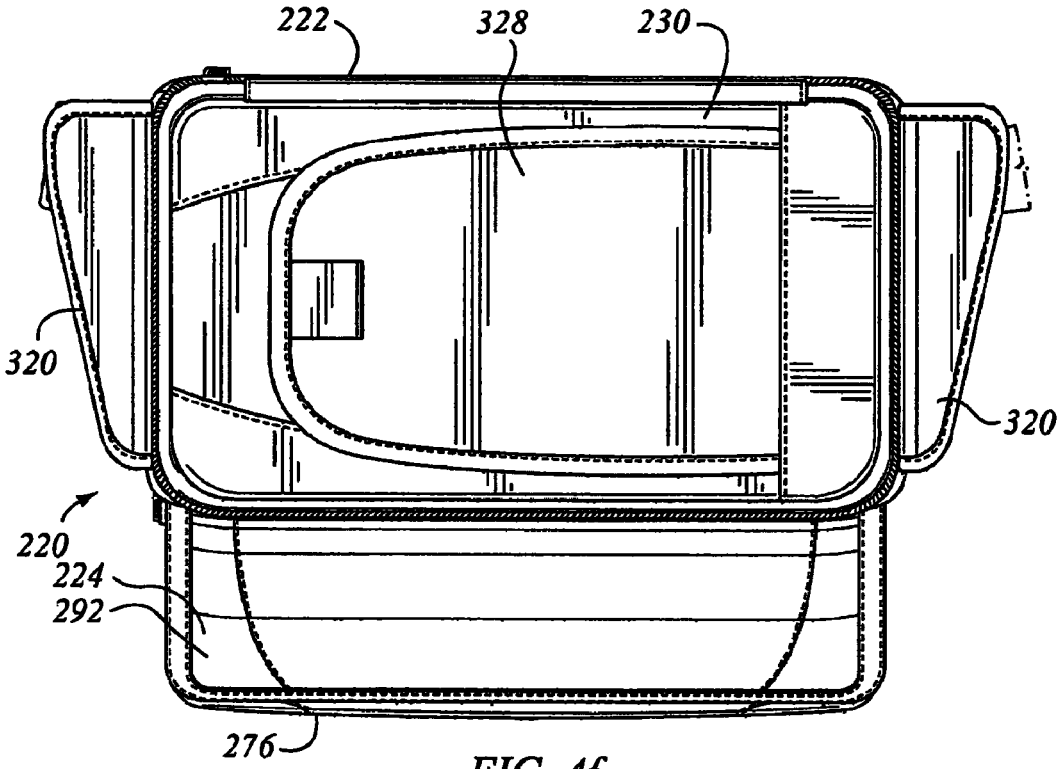
FIG. 4*f* is a top view of the container of FIG. 4*a* in a closed condition.
Figure 4G:
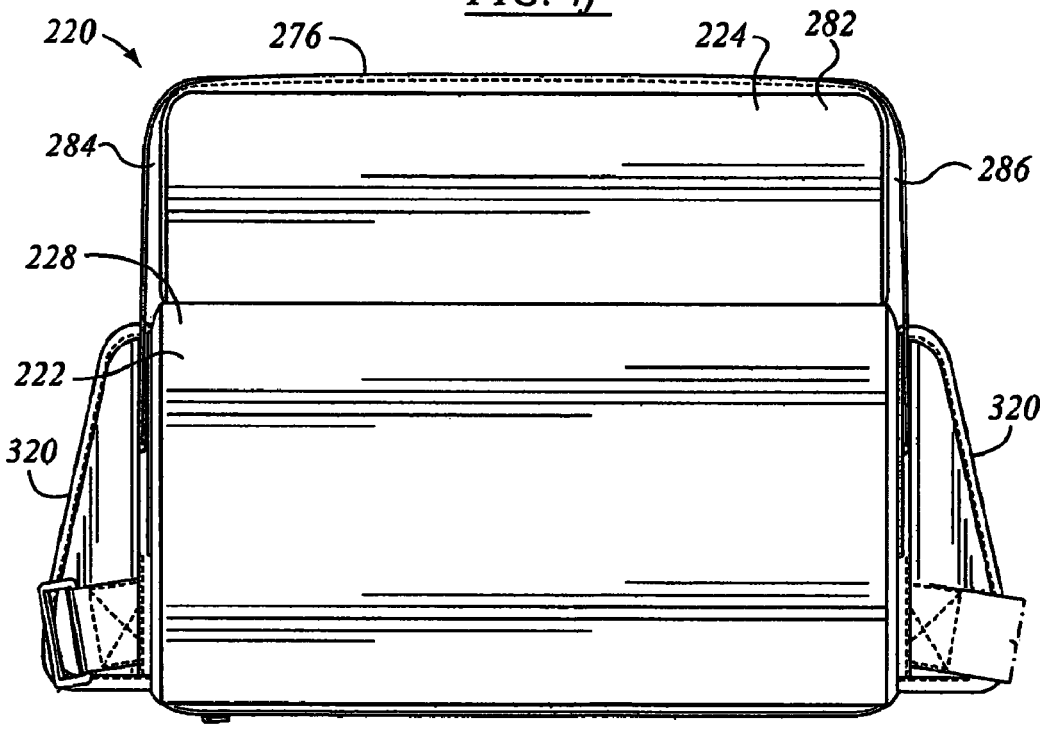
FIG. 4*g* is a bottom view of the container of FIG. 4*a;*
Figure 4H:
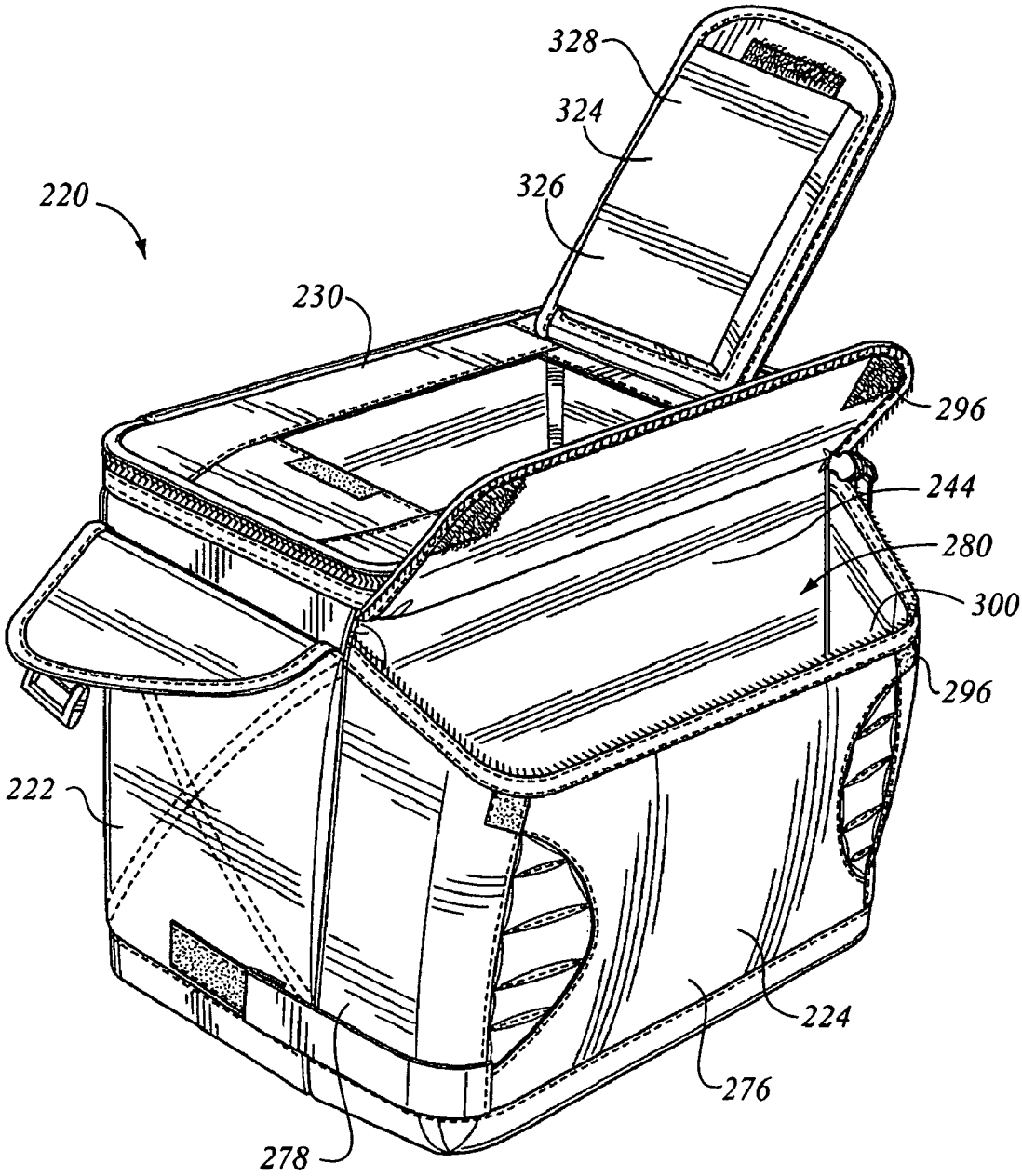
FIG. 4*h* is an isometric view of the container of FIG. 4*a* in an open condition.

Second insulated container portion 224 may also have a closure member, 290, that is movable between an open and a closed position, and that is thereby operable to govern access to accommodation 280. In one embodiment, closure member 290 may be a lid of flap 292, which may be hingedly attached along the upper margin of long side panel 244, generally opposite to the long side hinge. Flap 292 may have two attachment or securement fittings or sets of fittings: a first fitting 294 for securing flap 292 when second insulated container portion 224 is in an expanded position, as shown in FIG. 4*a*, and a pair of second fittings 296 for use when second insulated container portion 224 is in a collapsed position as shown in FIG. 3*a*. First fitting 294 may be a tracked fastener, such as a zipper 298, that runs about the rest of the lip 300 of the wall structure of second container portion 224, opposite to the hinged margin of flap 292. The other fittings 296 may include hook and eye fabric strips (e.g., Velcro™) mounted on the underside of flap 292 and at a corresponding location on the front face of panel 244. Second insulated container portion 224 may have further securement fittings, or retainers, 302, such as may be employed to hold a portion of second insulated container portion 224 in the collapsed position of FIG. 3*a*. In one embodiment, retainers 302 may be straps 304 having a first end 306 fixedly mounted to the front face of main panel 276, near bottom portion 282; and a second end 308 that may be releasably attached to a mating fitting, or fittings, 310, such as may be mounted to a side face of first insulated container portion 222. Second end 308 may be releasably attached in a first position corresponding to the collapsed position of FIG. 3*a*, and in a second position corresponding to the expanded position of FIG. 4*a*.

Insulated container assembly 220 may include a lifting member 312 such as may be attached at one or more locations such that when insulated container assembly 220 is suspended from lifting member 312, flap 292 may tend to be uppermost relative to the remainder of second insulated wall portion 224 generally, and bottom portion 282 in particular. As such, when being carried, objects may tend not to fall out of second accommodation 280. In one embodiment, lifting member 312 may have the form of a strap 314 mounted to topmost short side end wall portions 248, 250 of peripheral wall 232. Strap 314 may have a central load spreader pad 316. Each end 318 of strap 314 may be reinforced by a load spreading reinforcement, which may be in the nature of a gusset 320, which may be located near, and may have a margin running along and rooted to, the uppermost end of short side portions 248, 250, such that container assembly 220 may be carried over a user's shoulder. Gusset 320 may have a generally triangular form, and may have an apex 322 that is located asymmetrically relative to short end panel portion 248 or 250. As shown in the phantom portion of FIG. 3*f*, strap 314 may be mounted eccentrically relative the vertical centerline of short side portions 248, 250, and may be mounted to ascend at an angle, shown as angle. An extension of the centerline of strap 314 to bottom panel 228 may tend not to intersect the centroid C of panel 228 (or 230, as may be), but rather to pass between centroid C and back long side panel 246.

Alternately or optionally, insulated container assembly 220 may include an auxiliary access 324 to accommodation 254 in the nature of a lid or door 326 mounted as an inset in second panel 230. Auxiliary access 324 may have an insulated wall structure, and may include a wing 328, hingedly mounted to the main body of second panel 230. Door 326 may employ a different type of securement from the main closure securement of panel 230. That is, whereas the main closure may employ a zipper e.g. 264, and may work to permit general access to accommodation 254 for loading, or for addition or removal of, for example, ice. Door 326, by contrast, may be rather smaller, and may have a quick release fastener (such as Velcro™ strips), and may be of a size to permit a user to reach in and extract, an individual beverage can, without having to open the who upper portion of the container assembly. Door 326 may be of substantially the same, or predominantly the same construction as the other insulated portions of container assembly 220 more generally. Optionally, insulated container assembly 220 might also include external beverage holders, or auxiliary pockets, or lodgements similar to item 126 above, whether insulated or uninsulated.

As described above in the context of container assembly 20, insulated container assembly 220 may also be a soft sided insulated container assembly, in which the wall structure may typically include an outer layer or skin 130, an internal layer (or layers) of insulating material 132, and an inner layer or skin 134. Insulating material 132 may itself be a sandwich of insulating layers or sub-layers, such as a closed cell foam layer, 136, an open cell foam layer 138, and a closed cell foam layer 140. It may be that the outer layer, 130, may tend to be made of a relatively wear resistant material, be is a woven polyester material or some other. The internal layer may be a sheet of Nylon™, and may have a reflective inner surface. Optionally, one or more panels may have stiffening battens mounted therein, e.g., it may be desired that long side portion first panel 246 or first panel 228 be stiffened for suitability as a base upon which to rest insulated container assembly 220, either when resting in the opened position of or when being carried against a person's hip. In that case, either may include a reinforcement, or stiffener, such as may be identified as stiffening batten 142.

The principles of the present invention are not limited to these specific examples which are given by way of illustration. It is possible to make other embodiments that employ the principles of the invention and that fall within its spirit and scope of the invention. Since changes in and or additions to the above-described embodiments may be made without departing from the nature, spirit or scope of the invention, the invention is not to be limited to those details, but only by the appended claims.

I claim:

1. A soft sided insulated container assembly comprising:

a first container portion and a second container portion;

said first container portion being a soft-sided insulated container portion;

said first, soft-sided, insulated container portion having a length and a breadth and a depth, said length being greater than said breadth, and said breadth being greater than said depth;

said first, soft-sided, insulated container portion having a first panel, said first panel having a predominantly rectangular plan form, said rectangular plan form having a pair of first and second generally opposed long sides, and a pair of first and second generally opposed short sides;

said first panel having a periphery;

said first, soft-sided, insulated container portion having an insulated peripheral wall mounted about said first panel, said peripheral wall extending away from said first panel in a direction of said depth, and said insulated peripheral wall having a margin distant from said first panel;

said first, soft-sided, insulated container portion having a second panel, said second panel having a predominantly rectangular plan form having a pair of first and second long sides, and a pair of first and second short sides;

said second panel being hingedly mounted to said margin of said peripheral wall along one of said long sides thereof;

said second panel being movable between a closed position and an open position relative to said peripheral wall;

a first closure operable releasably to secure said second panel in said closed position;

said second container portion being a soft-sided;

said second soft-sided, container portion being mounted to said second panel of said first, soft-sided, insulated container portion;

said second soft-sided container portion being movable from a collapsed position to an expanded position, and said container assembly including members operable releasably to secure said second container portion in said collapsed position;

said second soft-sided, container portion having a predominantly rectangular footprint corresponding substantially to said predominantly rectangular plan form of said second panel of said first container portion, having respective first and second long sides, and respective first and second short sides; and said second container portion having a second closure mounted along one of said first and second short sides thereof;

said soft-sided insulated container assembly defining a lunch container assembly adapted for use maintaining either of foods and beverages in a cooled or warmed condition.

2. The container assembly of claim 1 wherein:

said peripheral wall has a pair of first and second short sides, and a pair of first and second long sides, those short and long sides standing along the respective first and second short and long sides of said first panel, said first short side of said peripheral wall being closest adjacent to said second closure member; and a lifting member is mounted to said peripheral wall whereby said first short side of said peripheral wall is positioned uppermost relative to said second short side of said peripheral wall when said container assembly is supported by said lifting member.

3. The container assembly of claim 2 wherein said lifting member is a handle mounted to said first short side of said peripheral wall of said first, soft-sided, insulated container portion.

4. The container assembly of claim 2 further comprising a second lifting member that includes a shoulder strap.

5. The container assembly of claim 1 wherein said second container portion includes a main panel and a peripheral wall, the main panel has a peripheral margin having a pair of long portions and a short portion adjoining each other in a U-shape, said short portion being distant from said second closure member, and said peripheral wall being collapsible to permit said main panel of said second container portion to move to a position closer to said second panel when said second container portion is in said collapsed position than when said second container portion is in said expanded position.

6. The container assembly of claim 5 wherein said second closure member has a first securement member operable to retain said second closure member in a closed position relative to said second container portion, and a second securement member operable to retain said closure member against said main panel when said second container portion is in said collapsed position.

7. The container assembly of claim 1 wherein an auxiliary lodgement is mounted to one of said long sides of said peripheral wall of said first, soft-sided, insulated container portion opposite to that long portion of said peripheral sidewall to which said second panel is hingedly mounted.

8. The container assembly of claim 7 wherein said lodgement is uninsulated, has a base which may be collapsed against said peripheral wall when not in use, and which has an open end closest to said first short side of said peripheral wall.

9. The container assembly of claim 1 wherein at least one of said first and second container portions has a liner.

10. The container assembly of claim 9 wherein said liner is more rigid than said insulated peripheral wall.

11. The container assembly of claim 1 wherein said insulated container wall of said first insulated container portion includes an outer skin, an inner skin, and a flexible foam insulation layer captured between said inner and outer skins.

12. The container assembly of claim 1 wherein a removable washable liner is mounted within said first insulated container portion.

13. The container assembly of claim 1 wherein said container is in which said length lies in the range of 1 to 2 times said width, and said length is in the range of 2 to 5 times said depth.

14. A lunch box assembly comprising:

a soft-sided insulated container having a first portion and a second portion;

said first portion having the shape of a rectangular box having a length, a width and a depth;

said length and width being greater than said depth;

said length being greater than said width;

said first portion including a wall structure, said wall structure including a soft-sided insulated panel having an inner layer, an outer layer, and a layer of foam thermal insulation located between the inner layer and the outer layer;

said wall structure including a front and a back, a first short side, a second short side, a first long side and a second long side;

said front and back panels each having a rectangular shape defined by said length and said width such that each has first and second long edges, and first and second short edges;

said first and second short sides each having a rectangular shape defined by said width and depth;

said first and second long sides each having a rectangular shape defined by said length and depth;

said first and second short sides and said first and second long sides co-operating to define an upstanding sidewall mounted peripherally about said back panel;

said upstanding peripheral wall and said back panel co-operating to define an soft-sided, insulated open-topped box having a first chamber therein, said first portion being of a size to accommodate a person's lunch;

said first long side having a first long edge margin adjacent to said first long edge of said back panel;

said first long side having a second long edge margin distant from said back panel;

said first long edge of said front panel being hingedly mounted to said second long edge margin of said first long side;

said front panel defining a lid of said open-topped box, said lid being pivotally movable between a first, closed position, and a second, open position;

said front panel defining an insulated wall permitting said first and second portions to be at different temperatures;

said first portion having a closure by which to secure said lid in said first, closed position relative to said open-topped box;

said upstanding wall of said first portion having an handle mounted thereto by which to carry said lunch box assembly;

said second portion being mounted to said front panel of said first portion;

said second portion including a main panel overlying said front panel;

said second portion defining a second chamber therein;

said main panel having first and second long sides and first and second short sides;

said second portion having a peripheral wall running about said first long side, said first short side and said second long side of said main panel;

said peripheral wall of said second portion being U-shaped and collapsible;

said second short side of said main panel defining an opening edge of said second portion at which access to said second chamber is provided;

said second portion including a closure member;

said closure member of said second portion being movable between a first, open position permitting access to said second chamber; and a second, closed position obstructing access to said second chamber at said second short edge of said main panel;

said main panel of said second portion being movable relative to said front panel of said first portion, said main panel being movable away from said first portion to a first opposed position spaced distantly from said front panel to define an expanded position of said second portion for carrying objects; and said main panel being movable to a second opposed position more closely adjacent to said front panel of said first portion to define a collapsed position; and said lunch box having members operable to secure said main panel in said second opposed position.

15. The lunch box assembly of claim 14 wherein said lunch box assembly includes a substantially rigid receptacle mounted within said first chamber.

16. The lunch box assembly of claim 14 wherein said first portion thereof includes a removable washable liner.

17. The lunch box assembly of claim 14 wherein said front panel has an inside face for orientation inwardly toward said first chamber when said front panel is in said closed position relative thereto, and said inside face has an ice pack retainer mounted thereto.

18. The lunch box assembly of claim 14 wherein said assembly includes a bottle holder and bottle mounted to one of said log sides of said first portion thereof

19. The lunch box assembly of claim 14 wherein said length is in the range of 1 to 2 times said width; and said length is in the range of 2 to 5 times said depth.

20. The lunchbox assembly of claim 14 wherein said a ratio of said length to said width to said depth is about 5:4:2, all being +/−30%.

* * * * *